US006137889A

United States Patent [19]

Shennib et al.

[11] Patent Number: 6,137,889

[45] Date of Patent: Oct. 24, 2000

[54] DIRECT TYMPANIC MEMBRANE EXCITATION VIA VIBRATIONALLY CONDUCTIVE ASSEMBLY

[75] Inventors: Adnan Shennib, Fremont; Richard C. Urso, Redwood City, both of Calif.

[73] Assignee: Insonus Medical, Inc., Newark, Calif.

[21] Appl. No.: 09/085,486

[22] Filed: May 27, 1998

[51] Int. Cl.[7] ..... H04R 25/00

[52] U.S. Cl. ..... 381/328; 3/326; 600/25; 607/55; 181/130; 181/134

[58] Field of Search ..... 381/328, 326, 381/FOR 130, FOR 133; 600/25; 607/55–57; 181/130, 134, 135

[56] References Cited

U.S. PATENT DOCUMENTS

| | | | |
|---|---|---|---|
| 3,594,514 | 7/1971 | Wingrove | 179/107 R |
| 3,764,748 | 10/1973 | Branch et al. | 179/107 E |
| 3,870,832 | 3/1975 | Fredrickson | 179/107 E |
| 3,882,285 | 5/1975 | Nunley et al. | 179/107 E |
| 4,606,329 | 8/1986 | Hough | 128/1 R |
| 4,628,907 | 12/1986 | Epley | 128/1.6 |
| 4,756,312 | 7/1988 | Epley | 128/420.5 |
| 4,776,322 | 10/1988 | Hough et al. | 128/1.6 |
| 4,817,607 | 4/1989 | Tatge | 128/419 R |
| 4,840,178 | 6/1989 | Heide et al. | 128/419 R |
| 4,957,478 | 9/1990 | Maniglia | 600/25 |
| 5,015,224 | 5/1991 | Maniglia | 600/25 |
| 5,015,225 | 5/1991 | Hough et al. | 600/25 |
| 5,163,957 | 11/1992 | Sade et al. | 623/10 |
| 5,220,918 | 6/1993 | Heide et al. | 128/420.6 |
| 5,259,032 | 11/1993 | Perkins et al. | 381/68 |
| 5,282,858 | 2/1994 | Bisch et al. | 623/10 |
| 5,338,287 | 8/1994 | Miller et al. | 600/25 |
| 5,425,104 | 6/1995 | Shennib | 381/68 |
| 5,456,654 | 10/1995 | Ball | 600/25 |
| 5,531,787 | 7/1996 | Lesinski et al. | 623/10 |
| 5,554,096 | 9/1996 | Ball | 600/25 |
| 5,624,376 | 4/1997 | Ball et al. | 600/25 |
| 5,654,530 | 8/1997 | Sauer et al. | 181/130 |
| 5,682,020 | 10/1997 | Oliveira | 181/130 |
| 5,701,348 | 12/1997 | Shennib et al. | 381/328 |
| 5,833,626 | 11/1998 | Leysieffer | 600/559 |

OTHER PUBLICATIONS

IBM Patent Server, U.S. Patent No. 5,730,699, Mar. 24, 1998, Abstract and Claim 1.

"The Wax Problem: Two New Approaches," The Hearing Journal/Aug. 1993, vol. 46, No. 8, pp. 41–48.

CIC Handbook, M. Chasin, pp. 12–14, 17–18, 27–28, 44, 56–58, 65–66.

*Primary Examiner*—Curtis A. Kuntz
*Assistant Examiner*—Suhar Ni

[57] ABSTRACT

A device to be worn in the ear of a subject provides a direct vibrational drive to the tympanic membrane through a vibrationally conductive assembly which couples vibrations from a vibratory transducer positioned within the ear canal proximal to the tympanic membrane. In one embodiment of the invention, the device is a hearing aid positioned inconspicuously deep within the ear canal. The vibrationally conductive assembly is removably attached to the umbo area of the tympanic membrane. The vibrationally conductive assembly is designed to conduct vibrations in the audible frequency range while absorbing static forces caused by device placement and ear canal movement attributable to jaw movements of the wearer, including speaking, eating, drinking, chewing, yawning, and so forth. The unique coupling characteristics of the vibrationally conductive assembly allow for a highly efficient transfer of vibrations in the audible frequency range to the tympanic membrane without exerting damaging forces on the tympanic membrane. The energy efficiency and non-occlusive design features of a hearing aid embodiment of the invention allow for long term use within the ear canal.

77 Claims, 11 Drawing Sheets

FIG. 8A
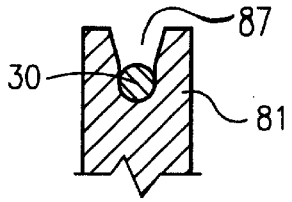
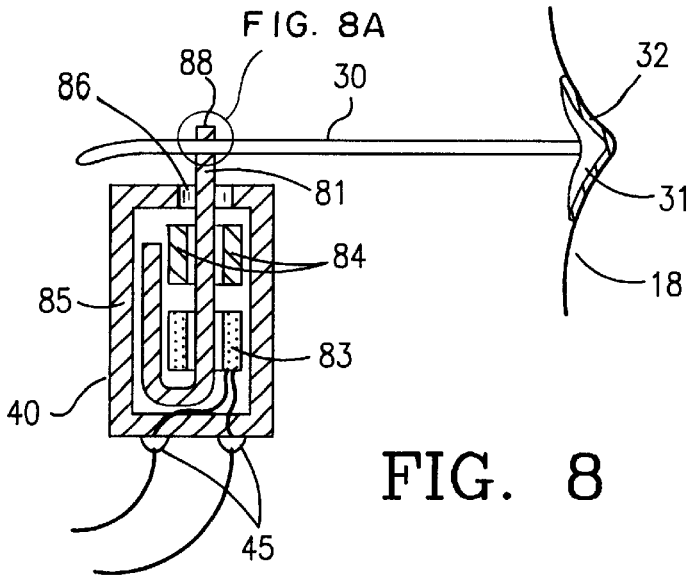
FIG. 8
FIG. 9
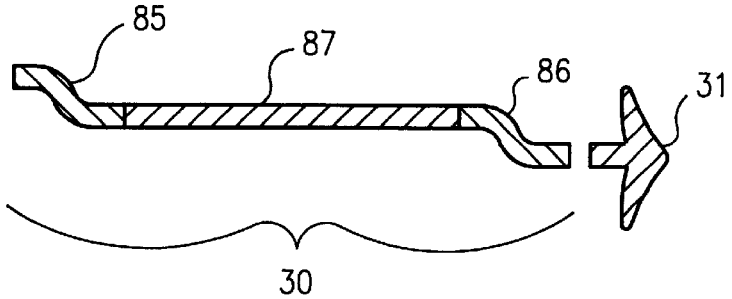
FIG. 9A
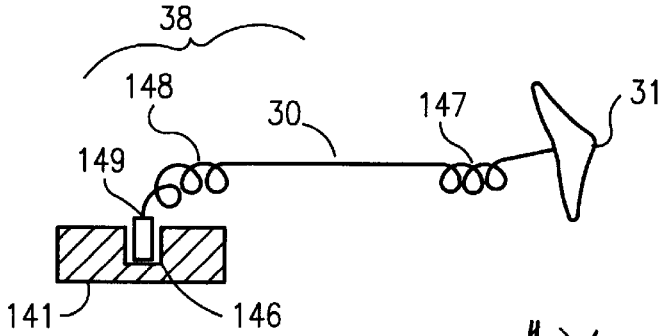
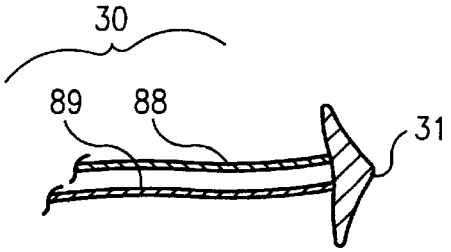
FIG. 10
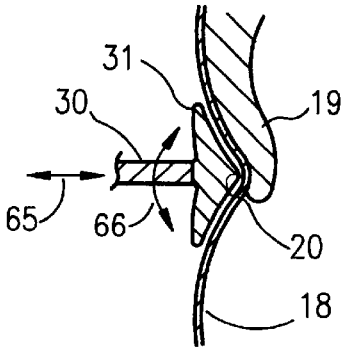
FIG. 11

Vibratory Frequency Responce of Various Filament Types

DIRECT TYMPANIC MEMBRANE EXCITATION VIA VIBRATIONALLY CONDUCTIVE ASSEMBLY

BACKGROUND OF THE INVENTION

The present invention relates generally to transducers for converting audio signals to audible vibrations, and more particularly to hearing devices with improved energy efficiency, sound fidelity, and inconspicuousness.

For the sake of a better understanding by the reader of the improvements provided by the present invention, it is useful to offer a brief description of the human ear canal anatomy and physiology. The external acoustic meatus (ear canal) is generally narrow and tortuous as shown in the coronal view in FIG. 1. The ear canal 10 is approximately 23 to 29 millimeters (mm) long from the canal aperture 17 to the tympanic membrane (eardrum) 18. The lateral part of ear canal 10 is a relatively soft region 11 because of underlying cartilaginous tissue, and moves in response to motions of the subject's jaw which occur during talking, yawning, eating, and so forth. Cerumen (earwax, not shown) production and hair growth 12 occur primarily in this cartilaginous region. The medial part of the canal is a bony region 13 which is rigid because of underlying bony tissue, and lies proximal to the tympanic membrane 18. The skin 14 in bony region 13 is thin relative to skin 16 in cartilaginous region 11, and is sensitive to touch or pressure. A characteristic bend 15 that roughly separates cartilaginous region 11 and bony region 13 has a magnitude which varies significantly among individuals. The cross-sectional shape (not shown) of ear canal 10 is generally oval with a long/short (vertical/horizontal) axis ratio ranging from 1:1 to 3:1. The diameter ranges from as little as 3 mm (along the horizontal axis of the bony region in small canals) to as much as 16 mm (along the vertical axis of the cartilaginous region in large canals).

Physiological debris including sweat, cerumen and oils produced by the various glands underneath the skin, are often present in the ear canal.

Ear canal 10 terminates at and is separated from the middle ear cavity 21 by the tympanic membrane 18, which is generally oval (FIG. 2) and conical (FIG. 1), with a characteristic dip at the umbo area 20 (FIGS. 1 and 2). The tympanic membrane weighs approximately 14 milligrams (mg) and is connected to the handle of the malleus ossicle 19, which itself has a weight in a range from about 22 to about 32 mg. The malleus ossicle is connected to other ossicles (incus 22 and stapes 23) and ligaments (not shown) within the middle ear cavity. Tympanic membrane 18 and associated middle ear ossicles 19, 22 and 23 are extremely sensitive to pressure waves which are imperceptible by even the most delicate receptors of skin.

Hearing loss affects a substantial percentage of the population, and is of several types. The loss occurs naturally with aging, beginning with the higher frequencies (4000 Hz and above) and increasingly spreads to lower frequencies. Conductive losses attributable to damage or disease of the tympanic membrane and associated ossicles also effect the hearing in the lower frequency range. It is customary, of course, to fit individuals who suffer from hearing loss with hearing aid devices, which are of many different types.

In general, conventional hearing devices rely primarily on air-conduction transducers to produce pressure waves which are transmitted to the tympanic membrane through the air between the transducer and the tympanic membrane. These transducers, also referred to as receivers or speakers, are used in various audio devices including hearing aids, telephones, radios and televisions. For such hearing devices, the efficiency of air-conduction is generally inversely proportional to the distance or residual volume between the receiver and tympanic membrane. The closer the receiver is to the tympanic membrane, the smaller the air mass between them, and thus the lower the energy required to vibrate the tympanic membrane.

Significant advances have been made in hearing aid receiver design during the past two decades, in energy efficiency, size and acoustic distortion reduction. These advances have led to a new class of miniature hearing devices that fit deeply in the ear canal, with receivers close to the tympanic membrane. Such devices are largely inconspicuous, and thereby tend to alleviate the social stigma and vanity concerns associated with wearing a visible hearing aid, which are considered the primary obstacles to use among the hearing impaired population. Nevertheless, a number of fundamental limitations remain in hearing devices that utilize air-conduction based technology, including problems of (1) frequent device handling, (2) acoustic feedback, (3) ear canal occlusion, and (4) low sound fidelity.

The problem of frequent device handling relates to the need, with conventional hearing devices, for frequent insertion and removal from the ear canal. Conventional hearing aids are typically removed daily to relieve the ear canal from device pressure and to aerate the ear canal and the tympanic membrane. The requirement of frequent handling, particularly with miniature hearing devices, poses a serious challenge especially to individuals who suffer physical impairment beyond hearing loss because of age or disorders, such as arthritis, tremors, or other neurologic problems.

Device removal is also required for battery replacement. For miniature canal devices (the term "canal devices" refers to miniature hearing devices that are primarily fitted in the ear canal, and includes In-The-Canal (ITC) devices and Completely-In-the-Canal (CIC) devices), typical battery lifetimes range from one week to four weeks. The need for frequent battery replacement is attributable in large part to the magnitude of energy consumption by conventional air-conduction receivers. State-of-the-art receivers consume electrical power in a range from 250 to 1000 microwatts ($\mu$W) to produce acoustic signals audible by the typical hearing-impaired individual (discussed below in the section regarding experiment B). Even with the most efficient currently available battery technology and dramatic reduction in power consumption of all other components of the hearing device, the receiver power consumption alone will lead to complete battery depletion within two to four weeks, depending on the amplification level (hearing loss). Battery type and size are limited because of typical ear canal size and shape constraints discussed above. For example, if a type 10A Zinc-Air battery (which represents the state of the art in miniature hearing aid batteries, having energy capacity of about 60 milliampere-hours (mA-Hr)) is employed with a conventional air-conduction receiver which consumes about 250 microamps ($\mu$A), the battery life will be only about 17 days, assuming a typical device use of 14 hours per day. Actual battery lifetime is shorter because of the additional power demands by other components of the hearing aid (not considered in the above calculation).

The problem of acoustic feedback occurs when a portion of the sound output, typically from a receiver (speaker), leaks to the input of the hearing system such as a microphone of a hearing aid. Such leakage often causes a sustained oscillation which is manifested by "whistling" or "squealing". Acoustic feedback, which is not only annoying to hearing aid users but also interferes with their speech communication, is a common occurrence in conventional hearing aids since the output of the device (acoustic) is in the same form of energy as the input of the device (also acoustic). Feedback is typically alleviated by occluding (sealing) the ear canal tightly with the hearing device. An additional sealing element may also be used to alleviate feedback as described in U.S. Pat. No. 5,682,020 to Oliviera and U.S. Pat. No. 5,654,530 to Sauer. Whichever acoustic sealing method is used, ear canal occlusion causes an array of side effects.

Occlusion related problems include discomfort, irritation and even pain; moisture build-up in the occluded ear canal; cerumen impaction; and occlusion effect. Discomfort, irritation and pain may occur from canal abrasion caused by frequent insertion and removal of a tightly fitted hearing device. The conventional hearing aid housing is typically made of custom shaped plastic material (e.g., acrylic) which easily causes pressure to and abrasion of the ear canal. A rigid enclosure is necessary to protect components within the hearing device during the daily handling routine. As observed by M. Chasin in *CIC Handbook,* Singular Publishing (1997), canal discomfort and abrasion result in frequent return of hearing devices to the manufacturer, seeking improved custom fit and comfort. Chasin further notes that long term effects of the hearing aid include atrophy of the skin and a gradual remodeling of the bony canal, with chronic pressure on the skin lining the ear canal which causes thinning of that layer and possible loss of skin appendages.

Moisture build-up in the occluded ear canal causes damage to the ear canal and the hearing device within. Chasin (ibid) further observes that humidity increases rapidly in the occluded portion of the canal, and is aggravated by hot and humid weather, exercise, and a tympanic membrane perforation; deep canal water saturation is higher than the ambient atmospheric humidity even with venting; and, since normally present bacteria thrive in an environment of high humidity and altered pH, the ear is now prone to infection. To reduce these damaging effects of canal moisture, it is often recommended that hearing devices be removed daily.

Chasin also states that cerumen impaction (i.e., blockage of the ear canal by ear wax) may occur when ear wax is pushed deeper in the ear canal by the inserted hearing device. Cerumen can also build up on the receiver of the hearing device, thereby causing frequent malfunction, and indeed, as Oliveira et al have observed (in *The Wax Problem: Two New Approaches,* The Hearing Journal, Vol. 46, No. 8), cerumen contamination is probably the most common factor leading to hearing aid damage and repair.

The occlusion effect is a common acoustic problem caused by the occluding hearing device, manifested by the perception of a person's own-voice ("self-voice") being loud and unnatural compared to that with the open ear canal. This phenomenon is sometimes referred to as the "barrel effect" since it resembles the experience of talking into a barrel. Referring to FIG. 3, the occlusion effect is generally related to self-voice 60 resonating within the ear canal. In an ear canal occluded by a hearing device 70, a large portion of the self-voice 60, originating from the larynx (voice-box) and conducted upward by various body structures, is directed at tympanic membrane 18, as shown by arrow 61. Even when a vent 71 is used, allowing a portion of self-voice 60 to escape as shown by arrows 62 and 62', the residual "trapped" sound energy 61 is perceived by the individual wearing the device as being loud or unnatural.

In the open (non-occluded) ear canal, shown in FIG. 4, a relatively larger amount of self-voice 60 is allowed to escape (arrow 63). The residual sound (arrow 64) directed at the tympanic membrane 18 is relatively smaller and is perceived by the wearer as natural self-voice. For hearing aid users, the occlusion effect is inversely proportional to the residual volume of air between the occluding hearing device and the tympanic membrane. Therefore, the occlusion effect is considerably alleviated by deep insertion of the device into the ear canal.

Low or inadequate sound fidelity is often experienced with air-conduction receivers (speakers), particularly in hearing aid applications. The acoustic response of an air-conduction speaker is characteristically limited to a particular range of frequencies. In the case of a high fidelity speaker system, for example, a limited frequency range exists but the system is designed using multiple speakers (e.g., woofers, tweeters, etc.) to achieve a broader frequency response. Unfortunately, space limitations in the ear canal do not allow for multiple receivers, and receivers which are used in canal devices are generally limited to a frequency range between 200 and 5000 Hz.

The limitations of conventional air-conduction hearing devices cited above are highly interrelated. For example, as Chasin (id.) observes, when a hearing aid is worn in the ear canal, movements in the cartilaginous region may cause slit leaks that result in feedback, discomfort, occlusion effect, and ejection of the device from the ear. Often, the relationship between the limitations is adverse. For example, occluding the ear canal tightly is desirable to prevent oscillatory feedback, but is to be avoided if one is seeking to prevent or diminish the various side effects of occlusion. The use of a vent 71 (FIG. 3) to alleviate occlusion effect provides an opportunistic pathway (74 and 74') for acoustic leakage between the air-conduction receiver 73 and the microphone 72, which tends to cause feedback. For this reason, the vent 71 in CIC devices is typically limited to a diameter in the range from 0.6 to 0.8 mm (see Chasin, id.).

Considering the state of the art in alternative hearing device technology, hearing devices employing transducers that are not based on air-conduction are well known in the art. The rational is that when no acoustic output is present in such devices, oscillatory feedback is usually reduced and in most cases eliminated. Distortion and frequency response characteristics are also potentially improved.

For example, vibratory middle ear implants attempt to circumvent some of the above-cited limitations by vibrating directly any of the ossicular (middle ear bones) or cochlear structures. Vibratory transducers and hearing devices for middle ear implant are disclosed in numerous patents, e.g., U.S. Pat. No. 3,594,514 to Wingrove, U.S. Pat. No. 3,764,748 to Branch, U.S. Pat. No. 3,870,832 to Fredrickson, U.S. Pat. No. 3,882,285 to Nunley et al, U.S. Pat. No. 5,015,224 to Maniglia, U.S. Pat. No. 5,282,858 to Bisch et al, U.S. Pat. No. 5,531,787 to Leisinski, U.S. Pat. Nos. 5,554,096 and 5,456,654 to Ball, and U.S. Pat. No. 5,730,699 to Theodore et al. The transducer technology employed includes piezoelectric and electromagnetic elements which provide electrical output via an electrical wire connection to the transducer. Disadvantages of middle ear implants include the cost and risk involved in the surgical procedure, and the additional surgery that may be required to repair device malfunctions or to replace an implanted battery.

Several other hearing systems that are less invasive have been proposed and are known in the art. Magnetic transducers which are surgically implanted or surgically attached to the tympanic membrane are disclosed in a number of patents, e.g., U.S. Pat. Nos. 4,840,178 and 5,220,918 to Heide et al, U.S. Pat. No. 4,817,607 to Tatge et al, U.S. Pat. Nos. 4,606,329, 4,776,322 and 5,015,225 to Hough et al, U.S. Pat. No. 4,957,478 to Maniglia, U.S. Pat. No. 5,163,957 to Sade et al, and U.S. Pat. No. 5,338,287 to Miller et al. These transducers typically employ high energy product magnets which vibrate in response to a radiant electromagnetic signal, representative of acoustic signals. The electromagnetic signal is typically radiated by a coil positioned in the external ear canal (e.g., 44 of FIG. 1 in the Manigila '478 patent, and 28 of FIG. 1 in the Tatge '607 patent). Similarly, a primary disadvantage of this type of device is the cost and risk of surgery performed on the delicate vibratory structures of the ear.

Among others of the less invasive approaches are those proposed in U.S. Pat. No. 5,259,032 to Perkins et al, and U.S. Pat. No. 5,425,104 to Shennib. In each of these disclosures, a magnet transducer is attached non-surgically to the exterior side of the tympanic membrane, and the transducer receives radiant electromagnetic signals from a device in the ear canal (FIG. 4 of the Perkins et al '032 patent), or from an externally positioned coil (FIGS. 1A and 1B of the Shennib '104 patent).

A major disadvantage with all of the above electromagnetic hearing systems is the inefficiency associated with transducing radiant electromagnetic energy into magnet vibrations, attributable to the relatively small portion of radiant electromagnetic energy produced by the coil that reaches the magnet. As is known in the art of electromagnetics, the efficiency of such coupling is inversely proportional to the distance between the driving coil and the magnet transducer. For example, a large externally positioned coil consumes about 1 ampere peak to produce roughly the same perceived sound pressure level as a small coil within the ear canal consuming only 5 mA peak (see the Shennib '104 patent). However, even for devices with small coils that are positioned deep in the ear canal proximal to the tympanic membrane, the power consumption is prohibitive for practical applications. This and other limitations of such devices render the various modes of radiant electromagnetic transconduction impractical for hearing aid applications.

A potentially more energy efficient transducer and hearing system is disclosed in U.S. Pat. No. 5,624,376 to Ball et al. In a non-invasive embodiment of the transducer disclosed in FIG. 19*a* of the Ball et al '376 patent, a floating mass transducer 100 is attached non-surgically to the exterior side of the tympanic membrane via an attachment membrane 502. The transducer 100 may be directly connected (not shown, but disclosed at col. 16, line 62) to a hearing device 506 via electrical wires 24. The "floating mass transducer" (FIG. 3), incorporates a magnet 42 (floating mass) and a coil 14 within a housing 10. The transducer 100 is free to vibrate within the housing 10 in response to the electrical signal via wires 24. The inertial forces of the vibrating magnet cause the housing to vibrate and subsequently vibrate the attached tympanic membrane and ossicles. According to the Ball et al '376 patent, vibration forces are maximized by optimizing the mass of the magnet assembly relative to the combined mass of coil and housing, and the energy product of the permanent magnet.

Since the transducer receives electrical energy directly from the hearing device via the electrical wire, energy loss is reduced and the device is potentially more energy efficient than air-conduction or radiant electromagnetic hearing systems. But a major disadvantage of the floating mass transducer is the weight of the transducer assembly. In a transducer example described at col. 22 of the Ball et al '376 patent, a NdFeB magnet of 2 mm in diameter and 1 mm length was employed, which has a calculated weight (magnet alone, from the volume and density of NdFeB 7.4 $gm/cm^3$) of approximately 23 mg, which well exceeds the typical weight of the tympanic membrane (14 mg).

Another alternative to air-conduction hearing devices is disclosed in U.S. Pat. Nos. 4,628,907 and 4,756,312 to Epley. The Epley '907 patent describes a canal hearing device with an electromechanical transducer part directly contacting the tympanic membrane (FIG. 1), the contact element 38 being secured to the tympanic membrane by clip means for attachment to malleus bone (claim 1). The devices are not only invasive as disclosed, but also pose a considerable risk to the delicate structures of the tympanic membrane from inadvertent movement of the hearing device, which may occur, for example, simply by normal jaw motion.

Many of these prior art devices are occlusive to the ear canal which render them impractical for long term use. As used in the present application, long term use means continuous placement and operation of a hearing device within the ear canal for at least one month.

A key goal of the present invention is to provide a highly energy efficient sound conduction means by vibrating directly the tympanic membrane without resorting to a transducer placed directly on the tympanic membrane.

Other goals of the present invention include the design of an inconspicuous and non-occlusive canal hearing aid for long term use.

SUMMARY OF THE INVENTION

The present invention provides a direct vibrational drive for the tympanic membrane through a vibrationally conductive assembly that couples vibrations from a vibratory transducer positioned proximal to the tympanic membrane. In a preferred embodiment of the invention, the vibratory transducer is part of a hearing device placed inconspicuously deep within the ear canal. The vibratory transducer vibrates a thin elongate vibrationally conductive member such as a filament. The other end of the filament is coupled to the tympanic membrane via a tympanic coupling element. The vibrationally conductive assembly is removably attached to the umbo of the tympanic membrane.

The assembly is designed to conduct vibrations in the audible frequency range while essentially absorbing static forces caused by device placement and ear canal movements. The unique coupling characteristics of the vibrationally conductive assembly allow for a highly efficient transfer of audible vibrations to the tympanic membrane without exerting damaging forces thereon. The energy efficiency and non-occlusive design features of a hearing aid embodiment of the invention enable long term use within the ear canal.

BRIEF DESCRIPTION OF THE DRAWINGS

The above and still further goals, objectives, features, aspects and attendant advantages of the present invention will be better understood from the following detailed description of the best mode presently contemplated for practicing the invention, with reference to certain preferred embodiments and methods, taken in conjunction with the accompanying Figures of drawing, in which:

FIG. 8 is a view of a detachable vibrationally conductive member by pressure fit (detail shown in FIG. 8A) to a vibrating armature of the vibratory transducer;

FIG. 9 is a view of a vibrationally conductive member consisting of multiple segments;

FIG. 9A illustrates another multi-segment vibrationally conductive member;

FIG. 10 is a view of the vibrationally conductive assembly utilizing a vibrationally conductive member comprising a filament with multiple strands;

FIG. 11 is a view of the tympanic membrane and the vibrationally conductive assembly showing axial and rocking vibrational modes;

DETAILED DESCRIPTION OF THE PREFERRED EMBODIMENTS AND METHODS

The present invention, illustrated in FIGS. 5–21, provides a vibrationally conductive assembly 38 to conduct vibrations in the audible frequency range to tympanic membrane 18. Assembly 38 consists of a thin elongate vibrationally conductive member, such as a filament shaft 30, and a tympanic coupling element, such as coupling pad 31 placed on the tympanic membrane 18 of a human subject (sometime referred to herein as the wearer of the hearing device, or simply, the wearer).

Figure 1:
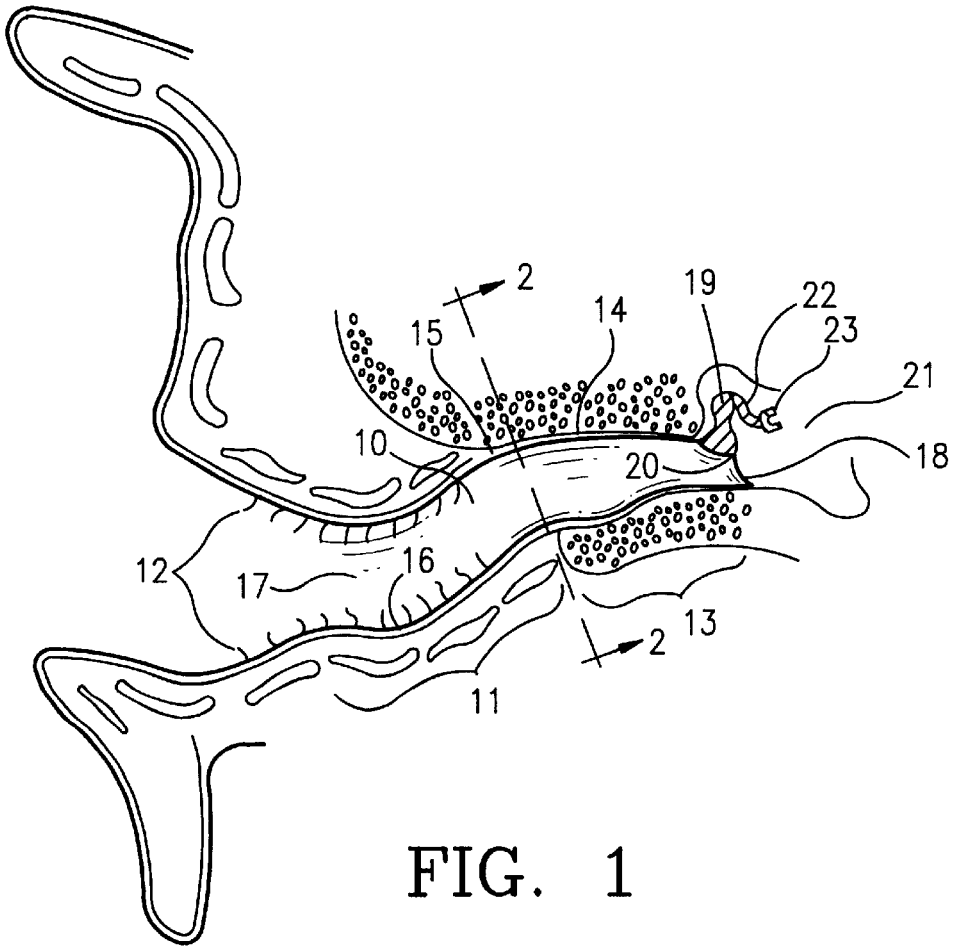
FIG. 1 is a coronal view of the external and middle ear showing the ear canal, the tympanic membrane and middle ear ossicles, described above.
Figure 2:
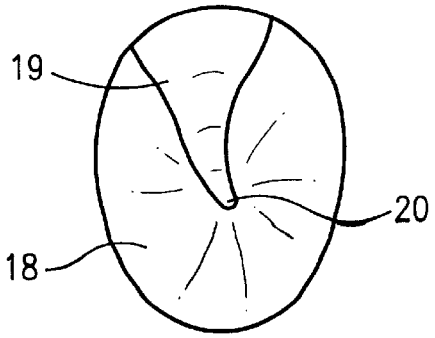
FIG. 2 is an illustration of the tympanic membrane as viewed from the ear canal showing the umbo and malleus handle, described above.
Figure 3:
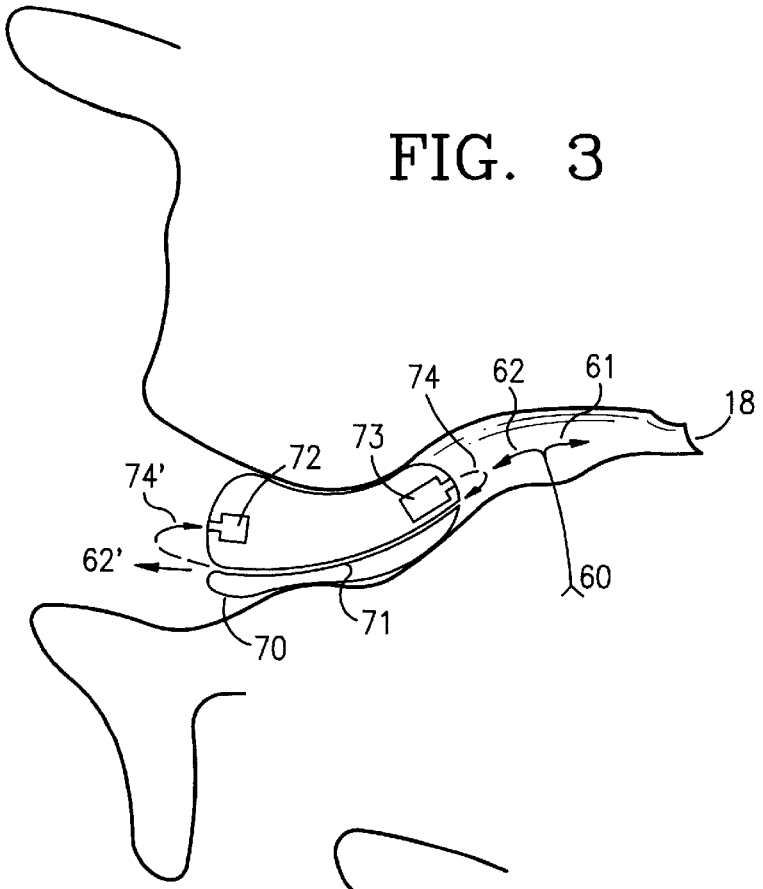
FIG. 3 is a view of the ear canal showing unnatural self-voice (occlusion effect) caused by occlusion of a conventional air-conduction hearing aid, described above.
Figure 4:
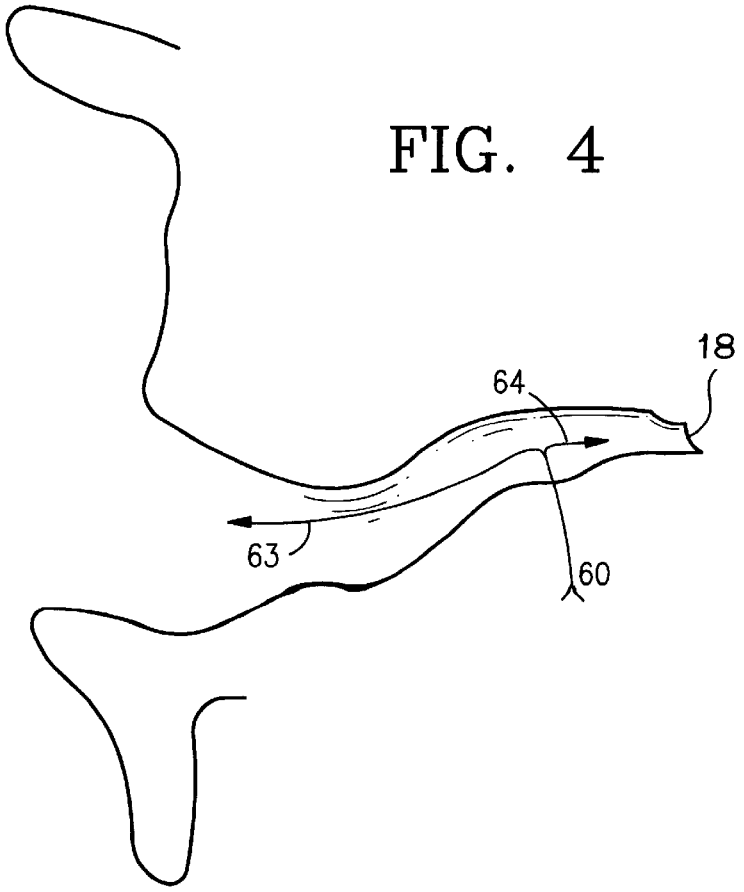
FIG. 4 is a view of the ear canal showing the natural self-voice perception in the open (non-occluded) ear canal, described above.
Figure 5:
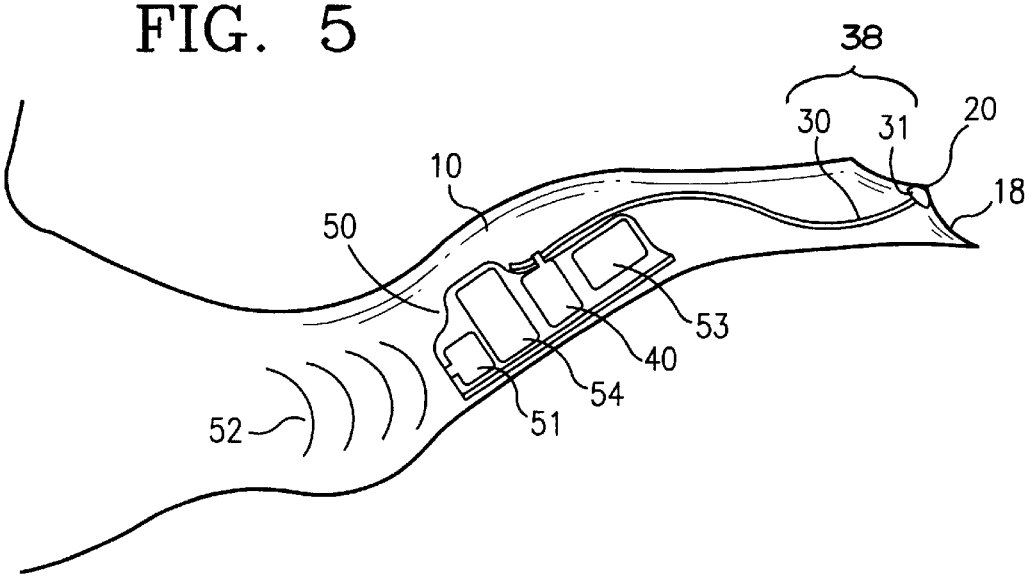
FIG. 5 is a view of a completely inconspicuous hearing device with the vibrationally conductive assembly of the present invention.

In a preferred embodiment of the invention, a vibratory transducer 40, part of a hearing device 50, is placed within the ear canal as shown in FIG. 5. The hearing device 50, configured as a hearing aid, contains a microphone 51 for receiving incoming audio signals 52 and transducing them to electrical signals, a processing amplifier 53 for processing and amplifying electrical signals from microphone 51, and a battery 54. The amplified signal from processing amplifier 53 is delivered to vibratory transducer 40 for generating vibrations representative of the incoming audio signals 52. Although audio signals may be speech of persons with whom the wearer is engaged in conversation, other sounds may be, more broadly, signals representative of audio signals from any source, such as wireless signals from an external audio transmitter, including electromagnetic, radio frequency, ultrasonic and optical signals.

A hearing aid typically comprises other components such as adjustment controls for non-programmable hearing aids or a programming interface for programmable hearing aids. These components are well known in the art of hearing aid design and are thus not shown in the figures, for the sake of simplicity and clarity.

In a preferred embodiment of the invention, shown FIG. 5, hearing device 50 is completely and non-occlusively concealed within the ear canal for maximum cosmetic appeal. The hearing device is also designed for long term use as made possible partially by the energy efficiency of the vibrational coupling mechanism of the present invention.

Figure 6:
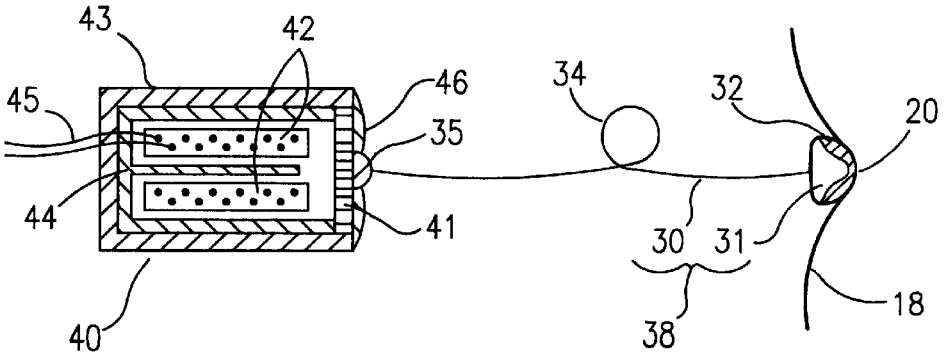
FIG. 6 is a view of the vibratory transducer and vibrationally conductive assembly showing the tympanic coupling element and vibrationally conductive member and strain relief.
Figure 7:
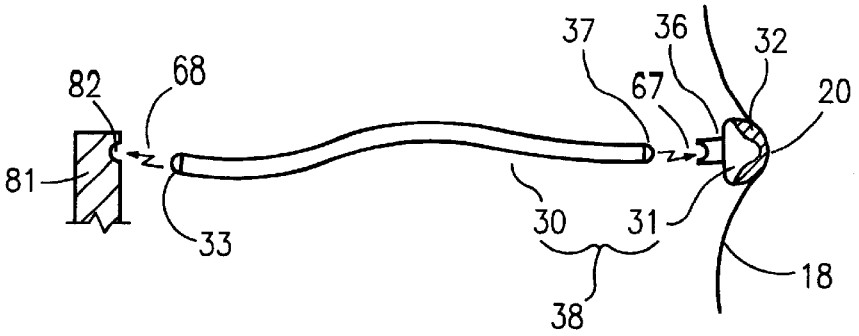
FIG. 7 is a view of a detachable vibrationally conductive member connected to the vibratory transducer and the tympanic coupling element by weak magnetic attraction.

Vibrationally conductive assembly 38, sometimes referred to herein as the filament assembly, and vibratory transducer 40 are shown in more detail in the exemplary embodiments of FIGS. 6–8. In the filament assembly, filament shaft 30 is connected to coupling pad 31, which may be coated by an interface contact coating 32 for enhancing the mechanical interface with tympanic membrane 18. The tympanic contact surface of coupling pad 31 or the coating 32 may be treated chemically, optically, or by the molding process to achieve various desired characteristics that include lubricity, wettability, antimicrobial, to conformity and adhesion. Contact coating 32, if used, is preferably a biocompatible gel, oil or like material, which provides weak adhesion between coupling pad 31 and tympanic membrane 18. Attachment of filament assembly 38 to the tympanic membrane is preferably made by weak adhesion forces between the coupling pad and the tympanic membrane to allow for easy removal of the filament assembly. The desired contact characteristics of coupling pad 31 may also be achieved by appropriate selection of the pad material, without any contact coating 32 or special surface treatment. For example, the pad material may be made of low durometer medical grade silicone or silicone gel which is soft and tacky. FIG. 8 shows an embodiment with a coupling pad 31 having an expanded contact area to enhance the mechanical or vibrational coupling to the tympanic membrane.

Vibrational coupling to the tympanic membrane may also be achieved via a weak static pressure (push force) exerted by the filament assembly on the umbo area. In any event, removable attachment methods are preferred. However, rigid adhesion methods (not shown) including glue and surgical attachment to the tympanic membrane or the malleus, are possible with techniques well known in the field of surgery, particularly related to ear (see U.S. Pat. No. 5,015,224 to Maniglia; and Bojrab, D. Semi-Implantable Hearing Device, Meeting of Triologic Society, Ann Arbor, Mich., Jan. 24, 1988, pp. 11–12).

Filament assembly 38 is designed to exert minimal static forces on tympanic membrane 18 to prevent damage to the ear structures. Static forces include push, pull and forces along the plane of the tympanic membrane. Static pressures occur primarily due to the placement of hearing device 50 and the attached filament assembly within ear canal 17. Transient forces can also occur during ear canal movements caused by jaw motions as described above. A strain relief may be incorporated in the filament assembly to reduce the stresses of static and transient forces on the tympanic membrane. For example, strain relief loop 34 is shown in FIG. 6. Other strain relief mechanisms will be readily apparent to persons skilled in the art.

Coupling pad 31 may be permanently attached to filament shaft 30 by molding the two parts from the same material, by insert molding of the parts during the manufacturing process, or by application of an adhesive (not shown). Alternatively, the filament shaft and the coupling pad may be mechanically detachable as shown in FIG. 7. In this embodiment, a magnetic receptor 36 on coupling pad 31, made of magnetic material, is weakly attracted to a magnetic tip 37 on the filament by a magnetic force 67. The magnetic tip 37 preferably articulates with receptor 36 to allow filament shaft 30 to freely articulate with respect to the coupling pad and tympanic membrane. This configuration will not only act as a "quick connect/disconnect" interface but also provide strain relief to minimize the static and transient forces as discussed above.

Oxygen access to the covered part of tympanic membrane 18 can be enhanced by fabricating coupling pad 31 from a material which is oxygen permeable. These materials are well known in the art of biomaterials (see, e.g., U.S. Pat. No. 4,540,761 to Kazunori et al). An oxygen permeable coupling pad is particularly suitable for long term applications on the tympanic membrane.

Filament shaft 30 may also be permanently or removably attached to vibratory transducer 40. In FIG. 6, the filament shaft is permanently attached to a vibratory diaphragm 41 by means of an adhesive 35. In FIGS. 7 and 8, filament shaft 30 is removably attached. In FIG. 7, filament shaft 30 has a magnetic tip 33 which is magnetically attracted and attached to a magnetic notch 82 of a vibrating armature 81 of vibratory transducer 40 (not shown). In FIG. 8, the filament shaft is alternatively attached to vibratory transducer 40 by means of a pressure fit. The end of filament shaft 30 is inserted into a wedge 87 on vibrating tip 88 of vibrating armature 81 as shown in the detailed cross-sectional view in FIG. 8A. After attachment of filament shaft 30 to vibratory transducer 40, any excess length can be trimmed by use of an appropriate cutting tool.

Other removable and adjustable length attachments (not shown) are possible and are within the scope of this invention as will become obvious to those skilled in the art. A removable attachment approach, at either or both ends of the filament shaft, has the advantage of allowing the individual parts of the hearing device to be easily attached and removed for installation, inspection, and replacement purposes. Furthermore, an easily detachable connection provides a safety mechanism during accidental or unintended motion of the hearing device or any part thereof Filament 30, or any other part of the filament assembly, may deteriorate with time due to the vibratory motion or the chemical environment of the ear. Therefore, a detachable approach is ideal for periodic replacement in disposable applications.

The filament assembly is preferably flexible and weighs less than the typical tympanic membrane (approximately 14 mg). This is possible because, unlike the tympanic contact transducers of the prior art (e.g., FIGS. 1–4 of the Perkins '032 patent, and FIGS. 18–21 of the Ball et al '376 patent), there are no transducer elements (magnet, coil, etc.) within the filament assembly. These transducer elements (not including the entire housing) weigh between 25 and 50 mg (Perkins, id., col. 12, line 63) and greater than 23 mg (Ball, id., as calculated above). It is known in the field of tympanic contact transducers that weights exceeding 25 mg begin to interfere with the inertia or dynamics of the tympanic membrane, leading to measurable loss of hearing. In all tested embodiments of the present invention, the weight of the filament assembly was significantly below weights of transducer elements used in the prior art and of a typical tympanic membrane (Experiment-A, below).

Static forces of the filament assembly on the tympanic membrane are minimal and are highly dependent on the length, diameter, stiffness and orientation of filament shaft 30 with respect to both the tympanic membrane and the vibratory transducer. These static forces can be minimized by pre-forming the filament to optimal shape during manufacture, or by bending it in-situ (within the ear canal) for the wire type filament, or by incorporating a strain relief 34 as shown in FIG. 6. Small static forces minimally interfere with the dynamic characteristics of the tympanic membrane, as compared with transducers of the prior art having elements positioned directly on the tympanic membrane.

The contact area of the coupling to the tympanic membrane is preferably at the umbo area 20, to provide optimal energy transfer by the lever action of the malleus 19. The shape of the coupling pad is preferably conical to match the natural shape of the umbo area, as shown in FIGS. 5–8. Preferably, the coupling pad and the filament are shaped and designed to allow self-centering within the conic shape of the umbo area. Self-centering not only assists in the fitting procedure, but also maintains a secure attachment afterward.

A prototype of the embodiment of FIG. 7 was constructed with two hemispherically shaped magnetic tips 33 and 37 of ceramic magnet material (approximately 0.5 mm large diameter×0.4 mm high) attached to nylon filament 30 (14 mm long and 0.14 mm diameter). A conically shaped coupling pad 31 was molded from hydrophilic vinyl polysiloxne (manufactured by Dentsply International Inc.). The large diameter of coupling pad 31 was approximately 3 mm and was attached by cyanoacrylate adhesive to a magnetic receptor 36 made from thin magnetic disk (1.5 mm diameter and 0.2 mm high). The weight of the filament including coupling pad and all magnetic structures was measured at about 7 mg. The magnetic attachment forces involved in this embodiment are sufficiently weak for easy detachment, yet strong enough to provide a reliable vibrational coupling.

The filament shaft may be made of any thin material which conducts audible vibrations to the tympanic membrane. Several examples of filaments were prototyped and tested as described in greater detail in Experiment-A below. Other possible designs (not shown) include ribbon, spiral, and composite material and configurations. A filament may consist of two or more segments, each with different physical properties to achieve overall characteristics not possible with each segment alone. For example, in FIG. 9, the filament shaft is made of short bendable segments 85 and 86 (i.e., metal wire) and a relatively longer and more resilient segment 87 (i.e. nylon filament). The bendable segments are designed to easily bend to optimize the fit of the filament within the ear canal. On the other hand, the resilient segment 87 may be selected for its superior vibrational characteristics. Therefore, such a composite filament shaft is easily bendable and vibrationally conductive.

In another configuration of the multi-segment filament shaft, shown in FIG. 9A, filament 30 comprises one or more coiled segments 147 and 148. Locking pin 149 secures the removable filament assembly 38 to a locking cavity 146 of a vibrational pad 141 within the vibratory transducer (not shown).

The filament may alternatively consist of multiple strands, as shown in exemplary configuration in FIG. 10, where filament shaft 30 is constructed of a pair of strands 88 and 89, each having a unique property. For example, each strand may have vibrational conduction in a unique frequency ranges, so that the combined frequency response is greater than the individual responses. Furthermore, each strand may be individually vibrated by a separate vibratory transducer in multi-vibratory transducer system (not shown). Multiple strands may be individually routed as shown, or braided (not shown).

The vibrational forces of the filament shaft 30 are primarily axial (push/pull) as shown by arrow 65 in FIG. 11. However, other modes of vibration—for example, a rocking motion as shown by arrow 66—may be advantageous for human perception in certain frequency ranges.

The vibratory conduction of the filament of the present invention is considerably more efficient than air-conduction or electromagnetic conduction of the prior art (see Experiment-B below). This is because the energy of the vibratory transducer 40 is more directly coupled to the tympanic membrane compared to the prior art. In air-conduction receivers, considerable energy loss occurs for vibrating the residual air mass between the receiver and the tympanic membrane. Minimizing the air mass by placing the air-conduction receiver less than 3–4 mm from the tympanic membrane is not practical, for safety and comfort reasons. Similarly, placing an electromagnetic coil less than 3.5 mm from the tympanic membrane is problematic (see Bojrab, ibid.). The present invention does not have this limitation for achieving a highly energy efficient vibratory transconduction.

The vibratory transducer 40 used in the present invention can be of any suitable mechanism which provides mechanical vibrations in the audible frequency range. In one embodiment, shown in FIG. 6, an electromagnet transducer is made of a vibrating diaphragm 41 formed from a thin magnetic sheet. A magnetic field generated from coil 42 and magnetic core 44 pushes and pulls on the vibratory diaphragm 41 according to the alternating current in coil 42. The current is delivered through electrical wires 45 originating from processing amplifier 53 within the ear canal (FIG. 5). Transducer 40 is encapsulated by a protective housing 43. The vibratory diaphragm 41 is covered by a flexible sealant 46, which allows the vibratory diaphragm to vibrate relatively freely.

In another embodiment, shown in FIG. 8, vibratory transducer 40 comprises a moving armature 81 which is positioned within two magnets 84 and coil 83. Similarly, the moving armature vibrates in response to alternating electrical current conducted through electrical wires 45. The transducer is typically enclosed in housing 85 and flexible seal 86 which seals the transducer while allowing the protruding tip 88 of armature 81 to vibrate freely. One advantage of the armature approach (FIG. 8) versus the diaphragm approach (FIG. 6) is in reduced feedback performance in hearing aid applications. This is because a diaphragm generates an acoustic output which can leak back into the microphone, thus causing feedback. However, the acoustic energy generated by a vibratory transducer is considerably less than that produced by air-conduction receivers (speakers) which are specifically designed to produce the maximum possible acoustic output. Of course, a diaphragm can be perforated to reduce its acoustic output energy, if desired.

The vibratory transducers of FIGS. 6 and 8 are merely exemplary of possible vibratory structures that may be used for coupling vibrational energy to the vibrationally conductive assembly of the present invention. Other vibratory transducers, known in the field of acoustics, electromagnetic and electromechanical design, may also be suitable for use with the present invention. This includes electrostatic, electret, magnetostrictive, piezoelectric, moving coils and other electromagnet configurations employing one or more magnets or coils (not shown).

Acoustic emissions are likely to develop within the ear canal due to the vibrations of the vibratory transducer or the tympanic membrane. However, these secondary acoustic emissions are far less than those emitted by conventional air-conduction hearing aids. Therefore, a hearing device of the present invention is relatively less prone to feedback than conventional hearing aids. Of course, for persons who are severely impaired, thus requiring significant level of transducer or tympanic vibrations, feedback may develop. In these situations, feedback control measures must be provided as will be described below.

The present invention exploits its low power consumption and feedback reduction characteristics to create new device configurations not possible with conventional air-conduction or electromagnetic devices. This includes a totally inconspicuous hearing device that is non-occlusive and suitable for long term wear within the ear canal.

Figure 12:
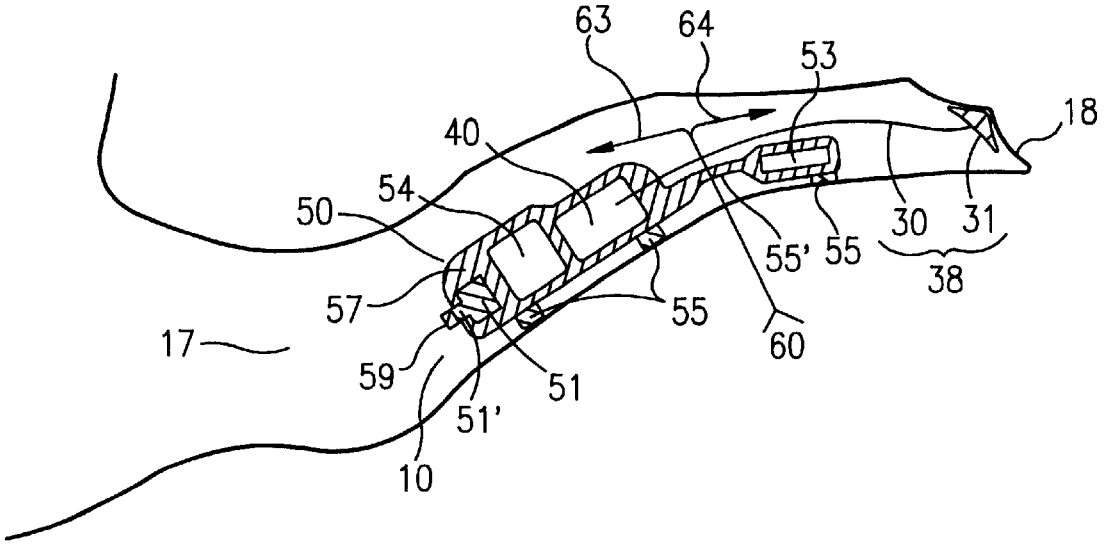
FIG. 12 is a view of a non-occlusive canal hearing device and vibrationally conductive assembly showing minimal canal contact and occlusion effect.

FIG. 12 shows a canal hearing aid of the present invention with the ear canal 10 non-occluded. This configuration alleviates many of problems found with occluding hearing devices of the prior art. The occlusion effect is minimized by allowing a large portion 63 of self-voice 60 to escape the ear canal, similar to the open ear canal condition shown in FIG. 5. Furthermore, tympanic membrane 18 and canal tissue are significantly exposed to circulating air as they are in the open ear canal condition. Since no sealing pressure is required to block receiver output, the hearing aid may be positioned with minimal skin contact and pressure. Contact pads 55, acting as spacers, further enhance the air exposure to the tissues of the ear canal and the tympanic membrane.

Figure 13:
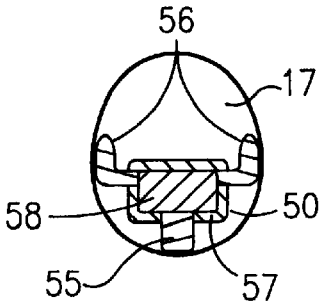
FIG. 13 is a cross-sectional view of the ear canal showing a non-occlusive hearing device with retainer.

A minimal contact and non-occlusive retainer 56 provides stability for the canal device as shown in the cross sectional view of the ear canal in FIG. 13. Contact pads 55 and retainer 56 are preferably soft biocompatible material such as medical grade silicone. Stability of the canal device may be achieved by applying a soft biocompatible adhesive (e.g., hydrogel) between the canal device and the skin of the ear canal (not shown).

Hearing devices of the prior art typically use rigid enclosures made of relatively thick material (typically, substantially exceeding 0.25 mm in thickness) to encapsulate and protect internal components e.g., 58, particularly since the devices require frequent removal and handling outside the ear canal. In a preferred embodiment of the present invention, the filament assembly 38 and overall hearing device 50 are adapted to be positioned in the ear canal for long term use. This not only eliminates the irritation of daily insertion and handling, but also allows the use of thin housings (less than 0.25 mm in thickness), which may be rigid or resilient. Although relatively less durable than housings of conventional hearing aids, thin housings have other advantages. Thin housing 57 (FIGS. 12–14) adds little to dimension and weight of the overall device, thus reducing the overall size, weight and pressure as compared with conventional devices. This offers significant advantages, especially for fittings in small and sensitive ear canals.

Another key advantage of the present invention is the elimination of custom (individualized) fabrication as required in most conventional hearing aids for the prevention of feedback. A non-custom fabrication leads to a mass producible device with benefits of lower production cost and improved product reliability.

Housing 57 or portions thereof may be soft, flexible and articulating (for example, articulating neck 55' of FIG. 12) so that the device will conform to various canal shapes and sizes. Hearing device 50, especially through the design of its housing 57, is preferably made waterproof to avoid damage to internal components or circuitry by water or moisture penetration. A moisture guard 59 (FIG. 12) placed on microphone sound port 51' serves to minimize such damage. The moisture guard is preferably made replaceable or disposable for discarding when moisture and debris accumulate therein.

Figure 14:
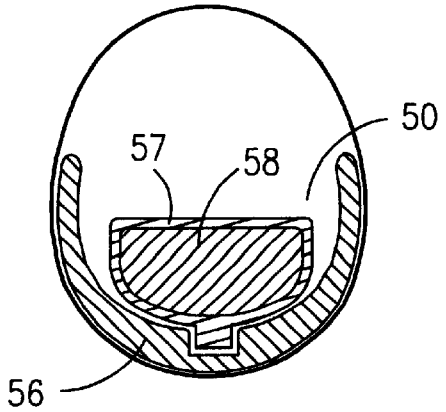
FIG. 14 is a cross-sectional view of the ear canal showing a non-occlusive hearing device and a removable retainer.

A non-occlusive retainer 56 embodiment shown in FIG. 14 may be made in assorted sizes and shapes and is removably attachable to the hearing device. The retainer, which is preferably elastic and composed of soft material suitable for canal contact, such as medical grade silicone or inert polymer foam, is attached to hearing device 50 by means of a pressure fit. The removable retainer is preferably disposable since it is likely to become soiled from the debris present within the ear canal. Other retainer attachment methods (not shown) including clip and snap mechanisms, adhesion and magnetic attraction are possible as will be apparent to those skilled in the art. Similarly, the retainer may be made of oxygen permeable material for enhancing skin exposure to oxygen in the air.

For long term applications, the hearing device is preferably adapted to be positioned substantially in the bony portion of the ear canal to optimize its cosmetic aspects of inconspicuousness when worn, and to avoid interference with cerumen production, which is limited to the cartilaginous portion of the ear canal.

Figure 15:
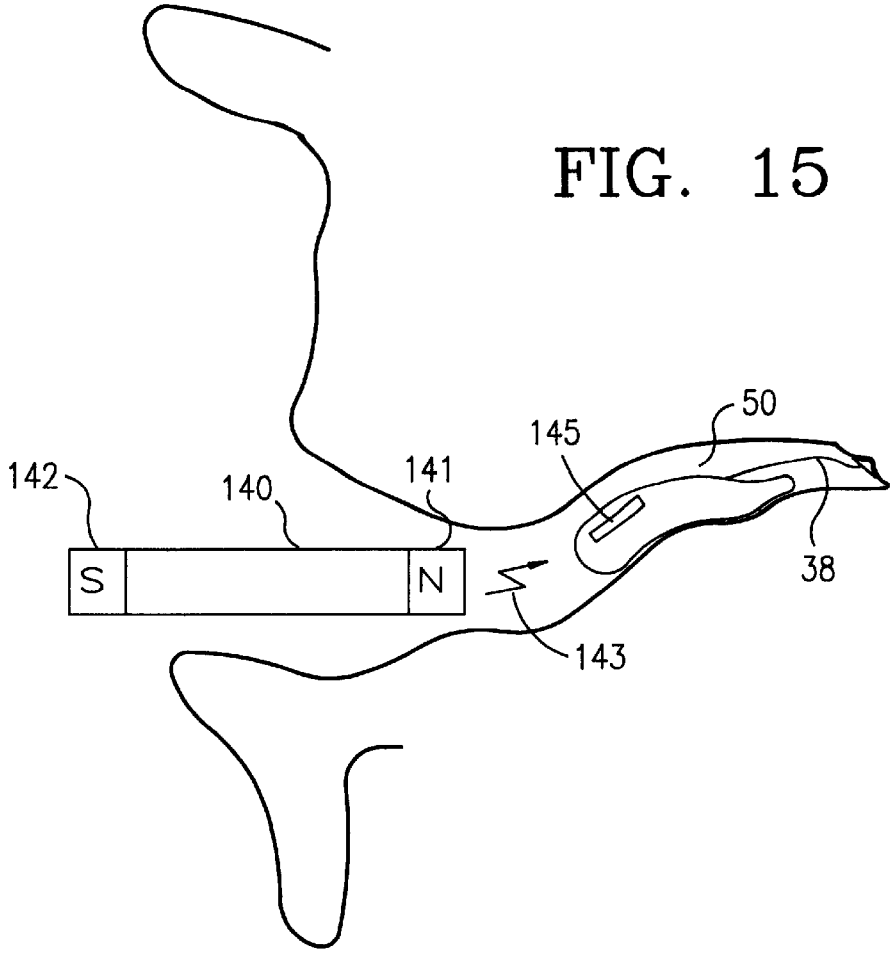
FIG. 15 is a view of a canal hearing device and vibrationally conductive assembly with a remote on/off control device.
Figure 16:
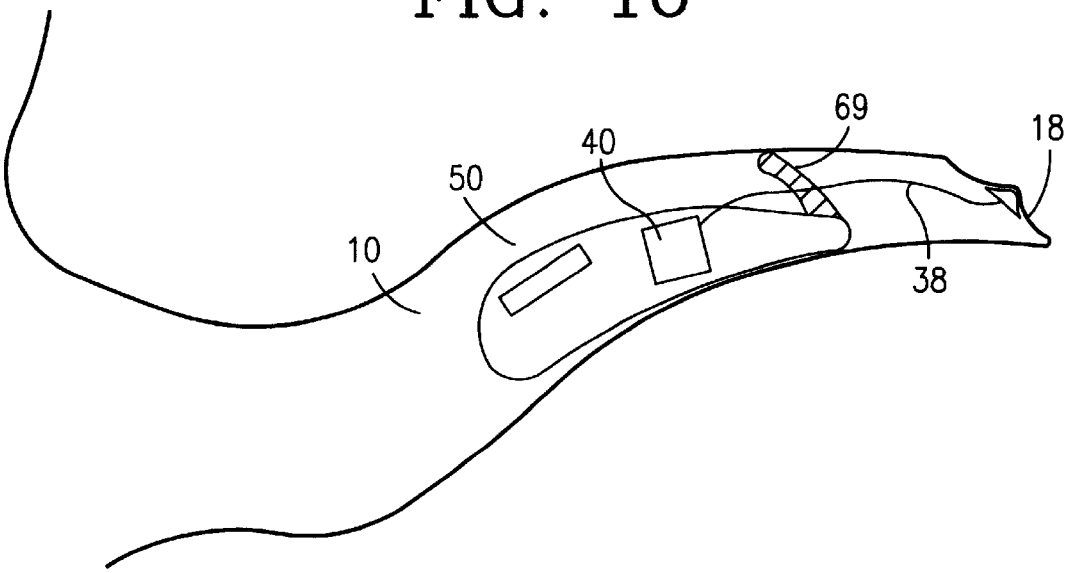
FIG. 16 is a view of canal hearing device and vibrationally conductive assembly with a sound screen for high gain conditions.
Figure 17:
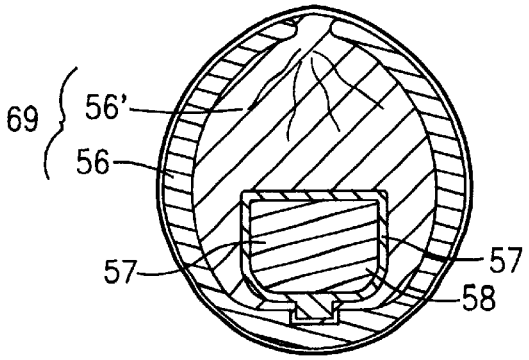
FIG. 17 is a cross-sectional view of the ear canal showing a hearing device and a removable retainer with a sound screen diaphragm.

In deep canal applications, a person wearing the device has limited access for manual on/off control or adjustment of the device. However, various remote control methods are widely employed and known in the art of hearing aid and implant remote control and communications. A simple yet practical remote on/off switch control for the device of the present invention is shown in FIG. 15. Hearing device 50 incorporates a miniature reed switch 145, which typically contains electrical contacts (not shown) hermetically sealed in a glass capsule. Placing a permanent magnet near the reed switch causes the contact "reeds" to either close or open a circuit. In this specific application, a latching reed switch 145 turns the hearing device on or off depending on the polarity of a magnetic field 143 produced by a magnetic device 140 with opposite magnetic polarities 141 and 142 on each end. By providing the device user with on/off magnetic device 145, the longevity of the battery can be further improved by turning off the power when the device is not needed (during sleep, for example).

As discussed above, in certain situations with severely impaired individuals, the acoustic energy produced by the vibrated tympanic membrane may be enough to cause feedback. For these exceptional conditions, an acoustic screen 69 may be incorporated into hearing device 50, shown in FIG. 16 as being deeply positioned in the bony portion of the ear canal, and minimally occlusive to the ear canal. The occlusion effect is also minimized by the small residual volume between acoustic screen 69 and tympanic membrane 18. Also, any occlusion effect attributable to the acoustic screen is not likely to be audibly perceived by persons with severe hearing impairment because of their elevated threshold of hearing. The acoustic screen may be functionally incorporated into the retainer, as at reference number 69 in FIG. 17, where acoustic screen/retainer 69 incorporates a screen diaphragm 56' for blocking or reducing the acoustic affects of tympanic membrane vibrations.

Periodic replacement of the battery and other disposable elements of the hearing device of the invention is not likely to be necessary before several months of use have elapsed, owing to its highly efficient design. The removable and disposable elements within the device include, for example, filament assembly 38 or portion thereof, battery 54, device retainer 56, acoustic screen 59 and microphone moisture guard 57.

Figure 18:
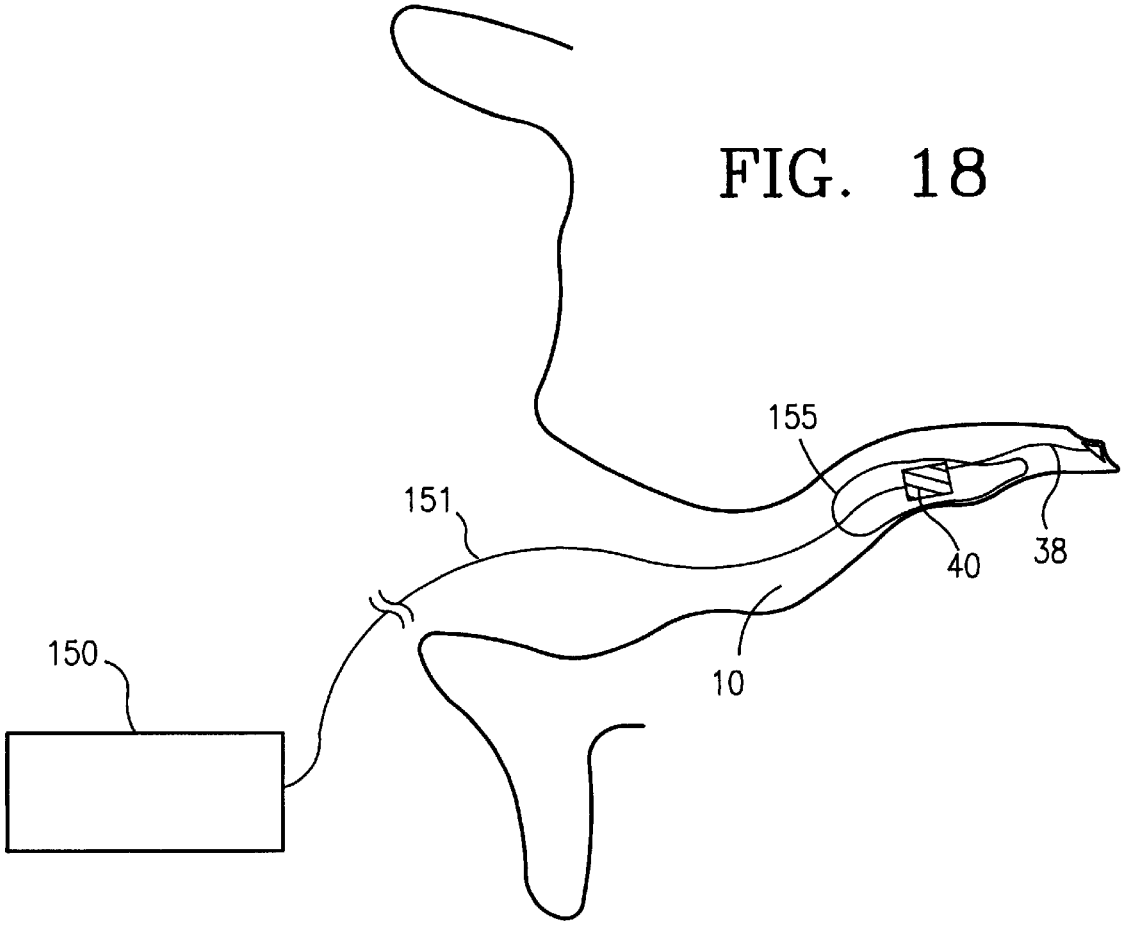
FIG. 18 is a view of a test module and external audiometric module for fitting and prescription applications.
Figure 19:
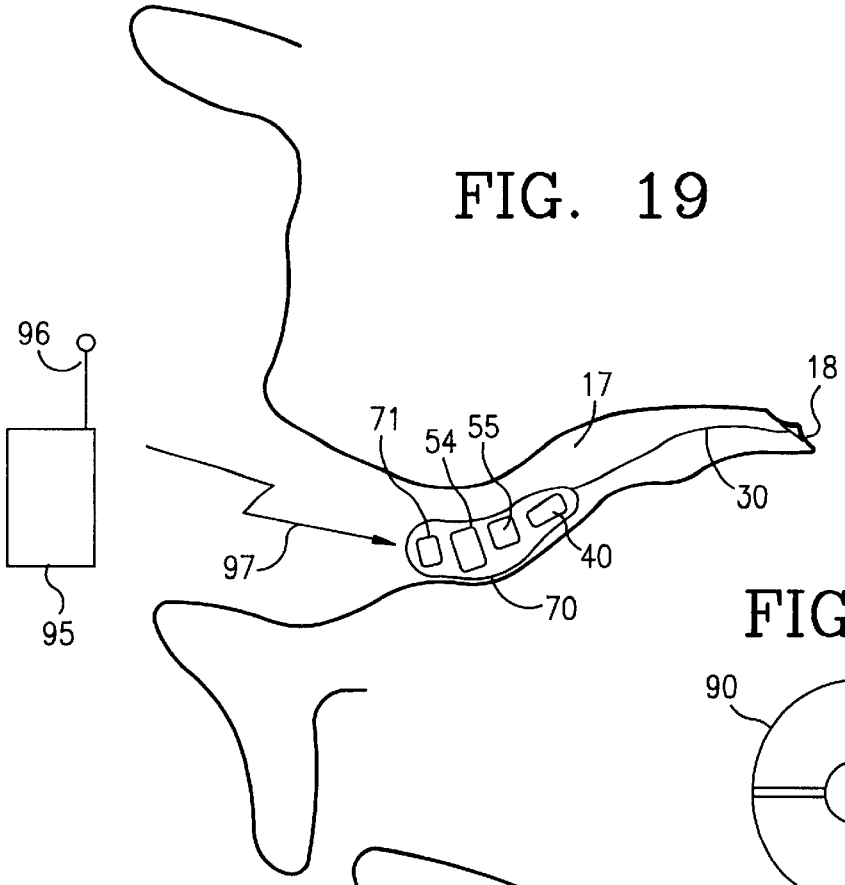
FIG. 19 is a view of a hearing device with vibrationally conductive assembly and an external audio device and transmitter for wireless communication applications.
Figure 21:
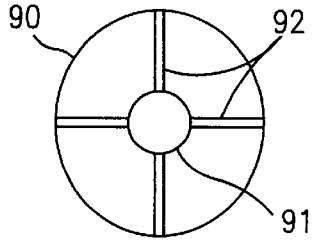
FIG. 21 is a cross sectional view of a magnet vibratory transducer.
Figure 20:
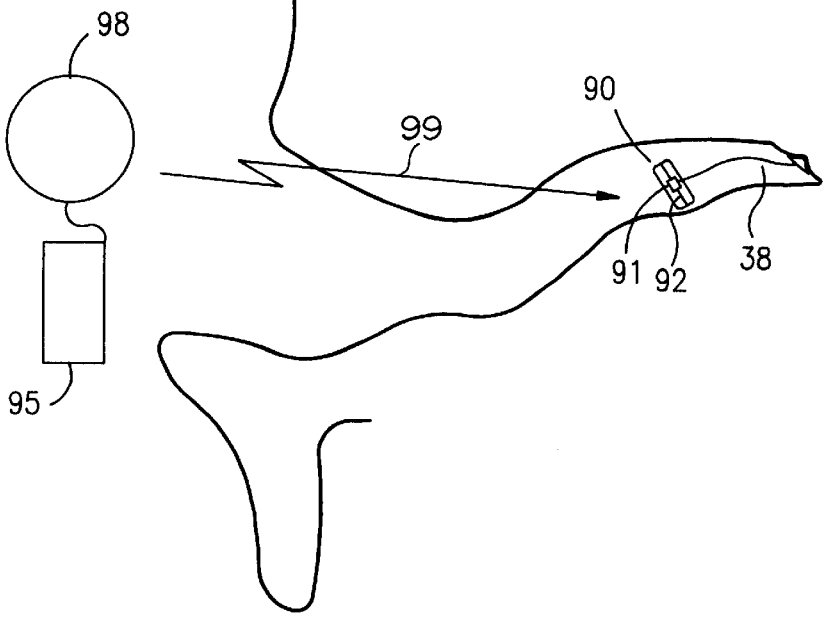
FIG. 20 is a view of a hearing device with no internal power source, consisting of a magnet vibratory transducer and a vibrationally conductive assembly.

Long term use in the ear canal strongly suggests a need for proper fitting of the device therein. To that end, the hearing device of the present invention is preferably inserted by an otolaryngologist (ear-nose-throat doctor) for proper inspection of the ear canal and tympanic membrane and for subsequent placement of the filament assembly and the hearing device. In the case of a hearing aid embodiment, prior to fitting the device, the electrical parameters (fitting prescription) of the hearing aid may be determined by placing a filament test module 155 comprising primarily the filament assembly 38 and vibratory transducer 40 in ear canal 10, as shown in FIG. 18. Filament test module 155 is connected to an audiometric test module 150 via electrical cable 151. The audiometric test module, which is located external to the ear canal, produces electrical test signals to perform audiometric evaluations with filament test module 155 in-situ (in the canal). Test signals for audiometric evaluation are well known in the art of hearing evaluation and include pure tones, narrow-band noise and speech signals for threshold and supra-threshold measurements. Audiometric evaluation is normally established in acoustic terms, i.e., decibels (dB) HL (hearing level) or dB SPL (sound pressure level). However, in this unique application it is preferable to establish audiometric evaluation in electrical terms to compute and transfer the electrical prescription more directly to the actual hearing aid to be fitted. The actual hearing aid may be adjusted manually or via electronic programming as commonly known in the art of programmable hearing aid technology. Of course, an actual hearing device may be used as a filament test module. The vibrationally conductive assembly 38 of the invention is not limited to hearing aid applications. Other applications include inconspicuous wireless communication systems as illustrated in FIGS. 19–21. A wireless communication system may consist of a canal hearing device 70 and an external audio device 95 (FIG. 19). Hearing device 70 is alternatively shown in the cartilaginous area of the ear canal to receive radiant wireless signal 97 from audio device 95 external to the ear canal. The external audio device 95 is equipped with a transmitting element 96 for sending radiant wireless signal 97 to a receiver element 71 within hearing device 70. The wireless signal 97, representative of audio signal, is typically of radio frequency (RF) type transmitted by a transmitter element 96 such as an antenna or a coil. Other radiant wireless transmission types and configurations (not shown) are well known in the art of wireless communications and include, for example, ultrasonic, optical, infrared and microwave signals. The receiver element 71 within hearing device 70 is appropriately selected for receiving the transmitted wireless signal 97. This includes, for example, coils, antennas, optical couplers and ultrasound microphones. The processing amplifier 55 of the hearing device 70 provides the appropriate amplification, decoding and processing for the signal transduced by receiver element 71. The processed signal is typically representative of an audio signal transmitted by audio device 95.

In yet another embodiment of the present invention, the hearing device consists primarily of a vibrating transducer 90 (FIG. 20), which directly vibrates in response to an externally generated radiant wireless signal 99. This unique configuration further reduces the size of the hearing device by eliminating sizable elements such as the battery and electronic components normally present within a hearing device. In the embodiment illustrated in FIGS. 20 and 21, the vibrating transducer 90 consists primarily of a magnet 91 which responds to a radiant electromagnetic field 99 transmitted by an a transmission coil 98. The transmission coil is connected to an external audio device 95, which provides electrical current to coil 98. The electrical current is representative of audio signal. The magnet 91 is suspended by a flexible support 92 (FIG. 21) or a diaphragm (not shown), which allows the magnet 91 to vibrate in response to a radiant electromagnetic field 98, representative of audio signal. The magnetic vibratory transducer 90 is similarly connected to the filament assembly as shown in FIG. 20.

The audio device 95, shown in FIGS. 19 and 20, may be part of any communication system for inconspicuously imparting audio information to an individual wearing the vibratory filament of the present invention. This includes telephone, "walkie-talkie", and other communication devices that should become apparent to anyone skilled in the art of communications once the principles of the disclosed invention are understood.

A significant advantage of a non-occlusive design of the present invention, whether for hearing aid or audio communication applications, is its ability to provide simultaneous dual sound perception. The first sound is conducted from the vibratory filament assembly as described above. The second sound is conducted to the tympanic membrane from outside the ear canal directly via air conduction in the non-occluded ear canal. This duality of sound perception has useful applications generally not possible with conventional hearing devices. In one example, a person with primarily high frequency loss may be provided with a hearing aid and filament assembly of the present invention for producing only high frequency vibrations, while relying on natural air-conduction for perceiving the low frequency sounds. In another example for communication applications, natural sounds from outside the ear canal are perceived simultaneously with privately perceived sounds via the communication device of the present invention.

Applications of the vibratory filament assembly for providing audible vibrations to the tympanic membrane are not limited to the above examples and should become obvious to those skilled in the art.

Figure 22:
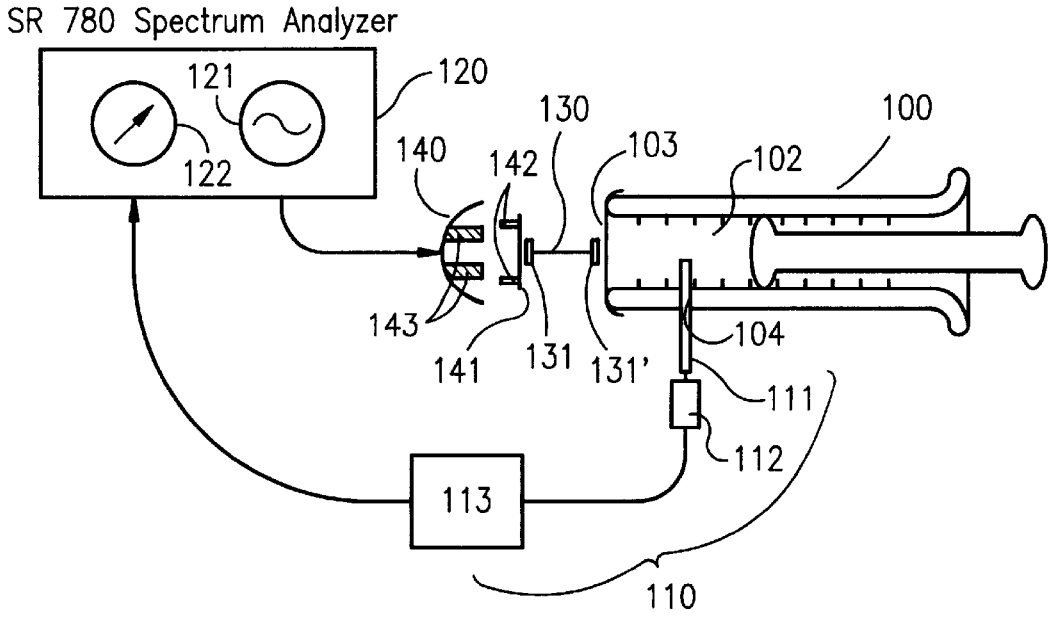
FIG. 22 is a schematic representation of a test setup for evaluating the vibratory characteristics of test filaments.

In a first experiment conducted by the applicants herein, referred to in this specification as Experiment A, the vibratory frequency response characteristics of several filament types (for use as vibrationally conductive members) were studied according to the setup shown in FIG. 22. Each test filament was placed between a vibratory pad 141 of a vibratory transducer 140 and a test diaphragm 103. The sound pressure produced by the test diaphragm 103 was measured in a test cavity 102, created by a syringe 100 as shown. The test cavity volume was set to 2 cubic centimeters (cc) according to the markings on the syringe 100.

The acoustic pressure in the test cavity 102 was measured by a probe tube system 110 (model ER-7C, manufactured by Etymotic Research) consisting of probe tube 111, probe microphone 112 and amplifier 113. Probe tube 111 was inserted within test cavity 102 via a hole 104 drilled in the syringe 100 as shown. A thin plastic sheet of approximately 0.08 mm thickness was used for the construction of test diaphragm 103. The 40 test diaphragm 103 was placed on the opening of test cavity 102 as shown, and was sealed on the test cavity by means of silicone rubber adhesive (not shown). Filament coupling pads 131 and 131' coupled the vibratory pad 141 of the vibratory transducer 140 to test diaphragm 103 via capillary adhesion through the application of mineral oil (not shown) on the interface surface of coupling pads 131 and 131'.

The vibratory transducer 140 was constructed by removing the bulk of a diaphragm of an insert earphone (model KP-HV-169 manufactured by Panasonic). The remaining central area of the diaphragm is referred to here as the vibratory pad 141. The vibratory transducer 140 was of the moving coil type with coil 142 electrically connected to signal source 121 within a spectrum analyzer 120 (model SRS-780, manufactured by Stanford Research Systems). The moving coil 142 responds to an alternating current from the signal source 121 and vibrates against a permanent magnet 143 (and other magnetic structures not shown for clarity). The moving coil is attached to the vibratory pad 141 which subsequently vibrates the filament shaft 130 via coupling pad 131.

A 100 mV broad-band white noise signal was used to stimulate the vibratory transducer 140 with each filament shaft tested. The frequency response of the acoustic pressure in test cavity 102 caused by the vibrations of each filament shaft was measured and displayed on the display 122 of the spectrum analyzer 120. This response represents the relative vibratory characteristics of each test filament.

The filaments were each cut to an approximate length of 14 mm. Each filament was connected to a pair of identical coupling pads 131 and 131' made of thin cylindrical plastic disks (approximately 2.5 mm diameter by 0.23 mm high). The weight of the entire filament assembly was also measured.

It is important to note that the diaphragm 103 and test cavity 102 only roughly model the tympanic membrane 18 and the middle ear cavity 21. The experiment was designed to demonstrate the vibrational coupling capability of filaments representative of the invention. The actual sound pressure perceived by humans is different and will vary considerably according to the anatomy and physiology of the individual ear.

The first filament shaft was made of ultra thin nylon filament (0.15 mm diameter, 4-lb, manufactured by Berkeley Outdoor Technologies). The second filament shaft was made of insulated 38 AWG copper wire (#1-210025-006, distributed by Warner Industrial Supply, Inc. ). The third filament was made of 4 braided insulated 44 AWG gold wires (#1-210025-007, also distributed by Warner Industrial Supply, Inc.).

Figure 23:
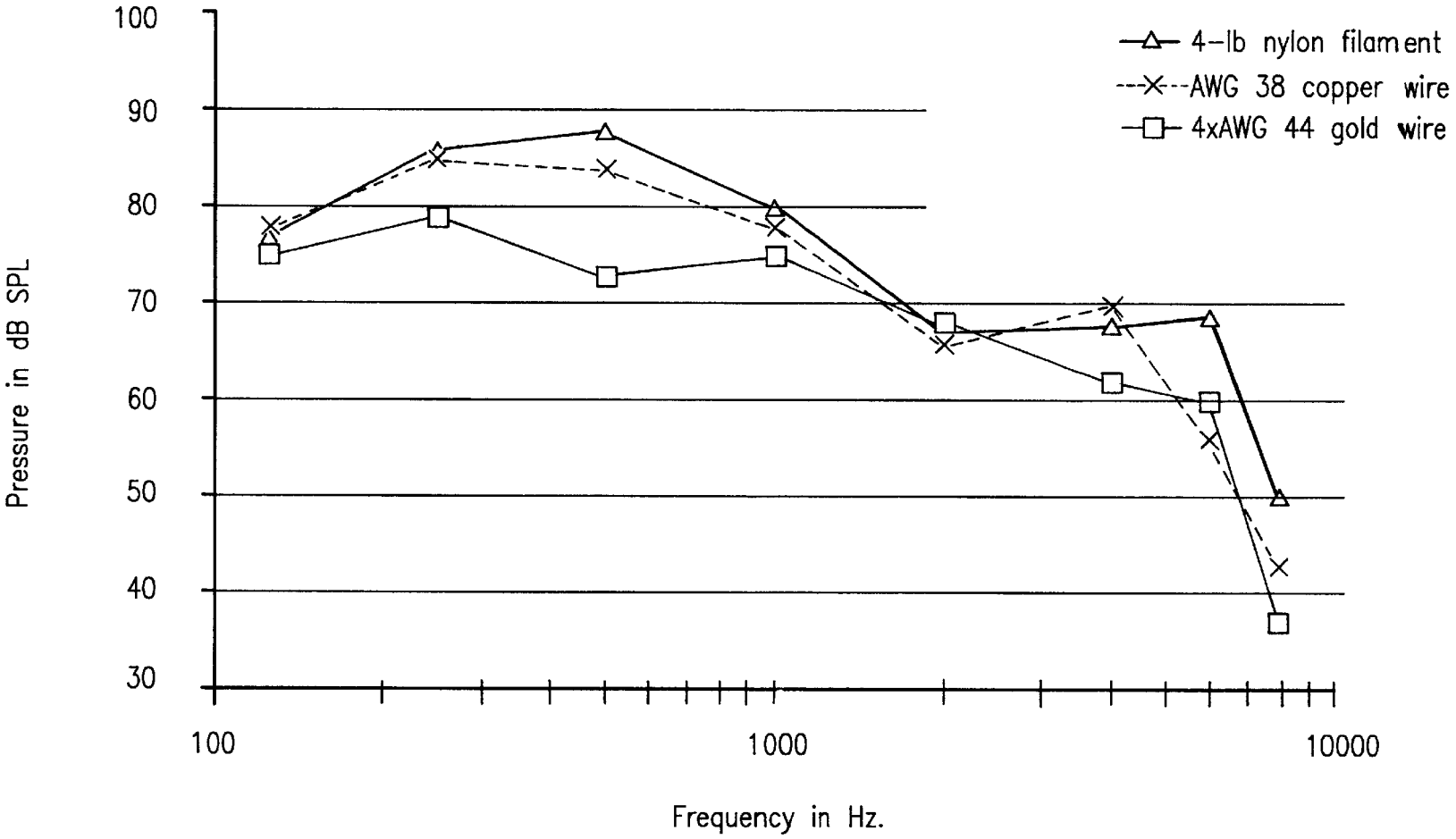
FIG. 23 is a graph of vibratory frequency response of various filament shafts.

Results and conclusion from Experiment A were as follows. The vibratory frequency response of the three filament assemblies is plotted in FIG. 23. All filament assemblies showed good vibrational conduction in the audible frequency range. Conduction in the low (below 500 Hz) and mid (500–1000 Hz) frequency ranges was particularly good. The relatively weak response in the higher frequencies may be attributed more to the limited frequency response of the vibratory transducer rather than the test filament.

| Filament Type | Diameter | Weight |
|---|---|---|
| Nylon filament | .15 mm | 5 mg |
| 38 AWG copper wire | .11 mm | 4 mg |
| 4 × 44 AWG (braided) | .05 mm each strand | 6 mg |

Figure 24:
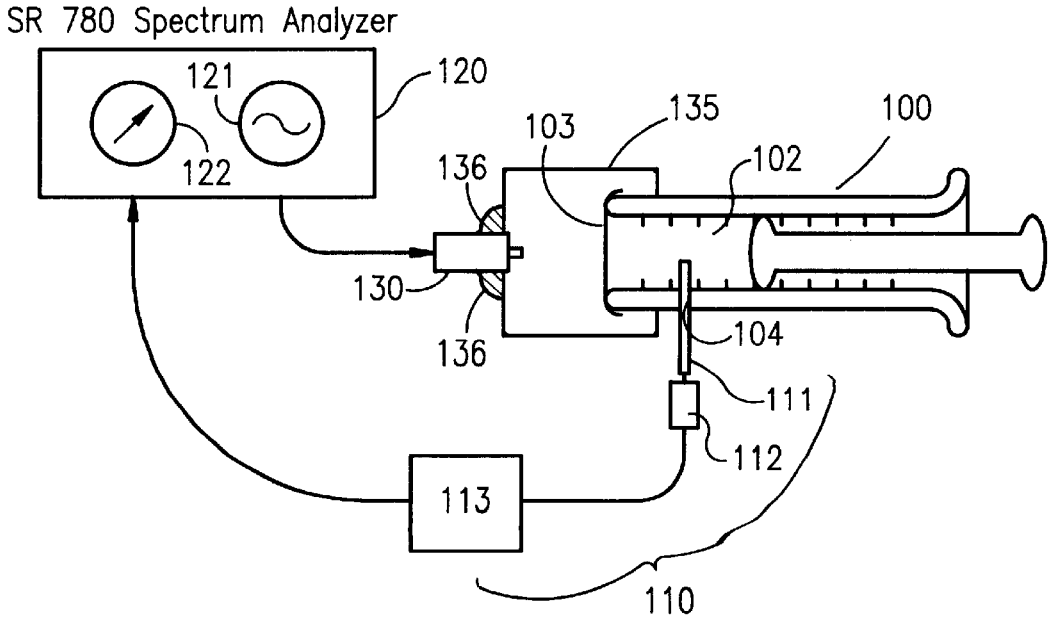
FIG. 24 is a schematic representation of test setup for evaluating the vibratory conduction of an air-conduction receiver (speaker)
Figure 25:
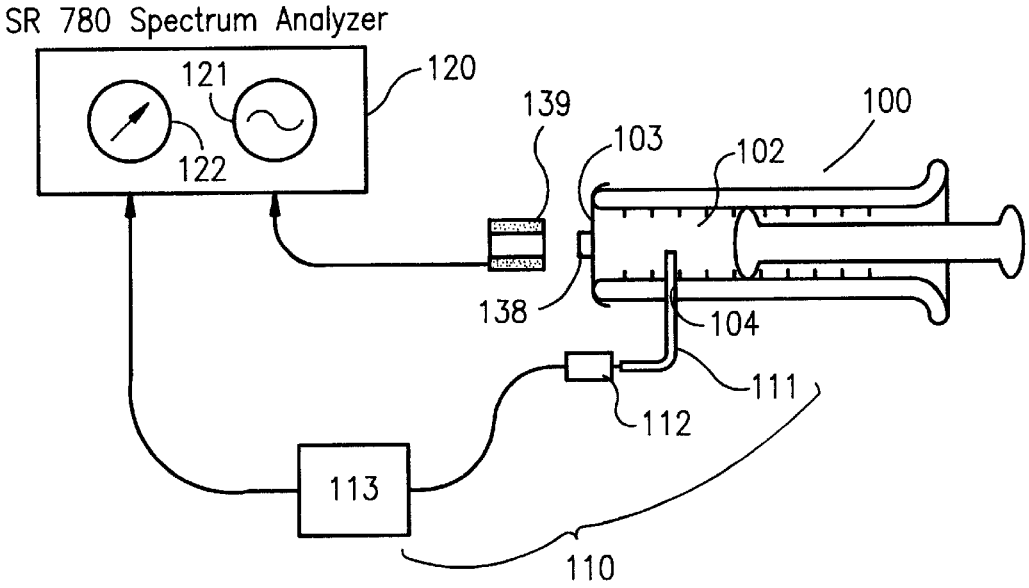
FIG. 25 is a schematic representation of test setup for evaluating the vibratory conduction of a radiant wireless electromagnetic system with a coil and a magnet.
Figure 26:
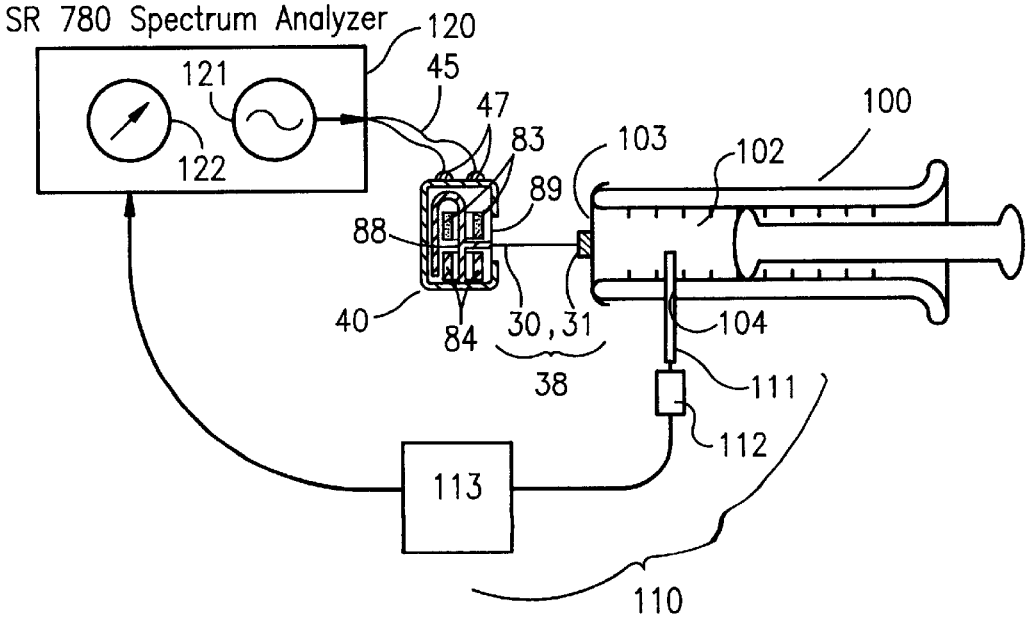
FIG. 26 is a schematic representation of test setup for evaluating the vibratory conduction of a filament assembly of the present invention.

In a second experiment conducted by the applicants herein, referred to in this specification as Experiment B, the vibrational efficiency and distortion in two types of vibratory mechanisms were compared with the mechanism of present invention. The vibratory mechanisms tested were: (1) an air-conduction receiver, (2) a radiant wireless electromagnetic transducer, and (3) a vibratory transducer and filament of the present invention. The experiment setup is shown in FIGS. 24–26.

In the experiment, the power consumption to produce a predetermined level of vibrations on a test diaphragm 103 was measured. The resulting vibrations on the test diaphragm 103 produced acoustic pressure in test cavity 102, created by a syringe 100 as shown in FIGS. 24–26. The test cavity volume was set to 2-cc according to the markings on the syringe 100.

The acoustic pressure in the test cavity 102 was measured by a probe tube system 110 (ER-7C, manufactured by Etymotic Research) consisting of probe tube 111, probe microphone 112 and amplifier 113. Probe tube 111 was inserted within test cavity 102 via a hole 104 drilled in the syringe 100.

A thin plastic sheet of approximately 0.08 mm thickness was used for the construction of the test diaphragm 103. The test diaphragm 103 was placed on the opening of test cavity 102 as shown, and was sealed on the test cavity by means of silicone rubber (not shown). Each transducer was coupled to the diaphragm 103 and test cavity 102 according to its mode of operation as described below.

The diaphragm 103 and test cavity 102 only roughly model the tympanic membrane 18 and the middle ear cavity 21. The actual sound pressure level perceived by humans is different and will vary considerably according to the anatomy and physiology of the individual ear. However, the test setup demonstrates the relative efficiency and characteristics of the test transducers.

A 1,000 Hz sine wave electrical signal was used to stimulate all three transducers. The electrical sine wave signal was produced by a 2-channel spectrum analyzer 120 (model SRS-780, manufactured by Stanford Research Systems), equipped with a signal source 121. The acoustic pressure, sensed by probe tube system 110, was measured and displayed by the display 122 of the spectrum analyzer 120 as shown. The electrical sine wave input level was adjusted for each transducer until the acoustic pressure within the test cavity 102 was 90 dB SPL. The power consumed by each transducer was measured by a multimeter (model ProTek 506 manufactured by Hung Chang Products Co, not shown). The total harmonic distortion (THD) was also recorded from the display 122 of the spectrum analyzer 120 for each transducer experiment.

For the air-conduction transducer experiment (FIG. 24), a moving diaphragm receiver 130 (model EH7951 manufactured by Knowles Electronics) was used. The EH7951 is a miniature receiver specifically designed for ear canal operations. The receiver 130 was coupled to the test cavity 102 via a standard hearing aid acoustic coupler 135 (CIC coupler, manufactured by Frye's Electronics). The coupling was sealed by a putty material 136 (Blu-Tack, manufactured by Bostik Pty. Ltd., Australia).

For the radiant wireless electromagnetic transducer experiment (FIG. 25), a coil 139 (approximately 6.0 mm OD, 3.0 mm ID, 2.0 mm long, gauge #38) was placed 3.5 mm away from a magnet 138 attached to the test diaphragm 103 by means of an adhesive. The distance and coil dimensions were consistent with the prior art (see Bojrab and Shennib, id.). The magnet 138 dimensions and magnetic energy specifications were similar to those described in the Perkins et al. '032 patent. Briefly described here, the magnet was a rare earth Neodymium Iron boron (NdFeB) type with magnetic energy of 32 MGOE and was frusto-conical having approximate dimensions of 2 mm large diameter by 1 mm small diameter by 1.5 mm high. Magnet 138 which weighed 22.5 mg was electroplated with thin layer of aluminum coating (adding negligible weight and dimensions). The magnet was attached to the membrane 103 by a trace amount of silicone rubber adhesive (not shown).

For the transducer of the present invention, a vibratory filament and transducer were constructed according to the configuration shown in FIG. 26. The vibratory transducer 40 was constructed from a modified air-conduction transducer identical to that used in the air-conduction experiment described above (EH7951). The receiver diaphragm 89, connected to vibratory armature 88) was attached to the filament shaft 30 by a cyanoacrylate adhesive (not shown). The vibratory armature 88 vibrates the receiver diaphragm 89 and the attached filament assembly 38 when an alternating current is applied from the signal source 121 to the coil 83 within the vibratory transducer 40. A coupling pad 31 was made of plastic material and was weekly adhered to the diaphragm by an application of mineral oil (not shown) on the interface surface. A nylon filament of approximately 14 mm in length and 0.14 mm in diameter was used for the filament shaft 30.

Results and conclusion from Experiment B were as follows. As shown in the summary table below, the vibratory filament and transducer of the present invention consumed only 6.1 $\mu$Watt versus 35.1 $\mu$Watt and 161 $\mu$Watt in the air conduction receiver and radiant electromagnetic transducers, respectively. This represents only 17.4% and 3.8% of the power consumed by the air conduction and radiant electromagnetic transducers, respectively. The distortion produced by the vibratory filaments was also lower than the air-conduction receiver but was comparable to that produced by the radiant electromagnetic transducer system.

| Transducer Type | Power ($\mu$W) | Distortion (THD) |
|---|---|---|
| Air-conduction Receiver | 35.1 | 1.02% |
| Radiant Electromagnetic | 161.0 | 0.3% |
| Vibratory Filament | 6.1 | 0.28% |

The energy efficiency of the vibratory filament of the present invention is considerably better than conventional air conduction and radiant electromagnetic transducers of the prior art. The distortion characteristics are also improved over conventional air-conduction receivers. The energy efficient low distortion vibratory system of the present invention is ideally suited for long term use and high fidelity applications.

Although a presently contemplated best mode of practicing the invention has been disclosed herein by reference to certain preferred embodiments and methods, it will be apparent to those skilled in the art that variations and modifications of the disclosed embodiments and methods may be implemented without departing from the spirit and scope of the invention. It is therefore intended that the invention shall be limited only to the extent required by the appended claims and the rules and principles of the applicable law.

What is claimed is:

1. A vibrationally conductive assembly constructed and adapted to fit within a human ear canal for coupling audible vibrations from a vibratory transducer to the tympanic membrane of a wearer of the vibrationally conductive assembly, said assembly comprising a thin elongate vibrationally conductive member coupled to said vibratory transducer for receiving and conducting vibrations emanating from the transducer to said tympanic membrane.

2. The vibrationally conductive assembly of claim 1, further including a tympanic coupling element adapted to contact said tympanic membrane for transferring said conducted vibrations thereto.

3. The vibrationally conductive assembly of claim 1, wherein said vibrationally conductive member is flexible.

4. The vibrationally conductive assembly of claim 1, wherein the assembly is constructed and configured to exert minimal static and transient forces on the tympanic membrane.

5. The vibrationally conductive assembly of claim 1, further including at least one strain relief mechanism associated with said vibrationally conductive member for minimizing static and transient forces on the tympanic membrane.

6. The vibrationally conductive assembly of claim 5, wherein said at least one strain relief mechanism comprises a flexible loop within said vibrationally conductive member.

7. The vibrationally conductive assembly of claim 5, wherein said at least one strain relief mechanism comprises a flexible coil segment within said vibrationally conductive member.

8. The vibrationally conductive assembly of claim 5, wherein said at least one strain relief mechanism comprises a pivotal connection provided by weak magnetic attraction.

9. The vibrationally conductive assembly of claim 1, wherein said assembly weighs less than said tympanic membrane.

10. The vibrationally conductive assembly of claim 2, wherein said tympanic coupling element comprises a conforming surface for contacting the external surface of said tympanic membrane.

11. The vibrationally conductive assembly of claim 2, wherein said tympanic coupling element comprises a soft surface for contacting the external surface of said tympanic membrane.

12. The vibrationally conductive assembly of claim 11, wherein said soft surface is selected from a group comprising silicone, gel, or like material.

13. The vibrationally conductive assembly of claim 2, wherein said tympanic coupling element is adapted for removable attachment to the tympanic membrane by means of relatively weak adhesion force.

14. The vibrationally conductive assembly of claim 13, wherein said relatively weak adhesion force means includes a biocompatible agent between said tympanic coupling element and said tympanic membrane for providing adhesion therebetween.

15. The vibrationally conductive assembly of claim 14, wherein said biocompatible agent is selected from a group comprising gel, oil, or like material.

16. The vibrationally conductive assembly of claim 2, wherein said tympanic coupling element is self-centering with respect to the umbo area of the tympanic membrane during attachment thereto.

17. The vibrationally conductive assembly of claim 2, wherein said tympanic coupling element is surgically attached to one of either the tympanic membrane or the associated malleus ossicle.

18. The vibrationally conductive assembly of claim 2, wherein said tympanic coupling element is secured to the tympanic membrane by means of a biocompatible adhesive.

19. The vibrationally conductive assembly of claim 2, wherein said tympanic coupling element comprises a substantially conic surface adapted to fit within the umbo area of the tympanic membrane.

20. The vibrationally conductive assembly of claim 2, wherein said tympanic coupling element is removably attached to the tympanic membrane by means of a relatively weak static push force.

21. The vibrationally conductive assembly of claim 2, wherein said tympanic coupling element is removably connected to said vibrationally conductive member.

22. The vibrationally conductive assembly of claim 21, wherein the removable connection between said tympanic coupling element and said vibrationally conductive member comprises magnetic elements therein for establishing a relatively weak magnetic attraction therebetween.

23. The vibrationally conductive assembly of claim 2, wherein said tympanic coupling element is composed of oxygen permeable material.

24. The vibrationally conductive assembly of claim 1, wherein said vibrationally conductive member is removably connected to said vibratory transducer.

25. The vibrationally conductive assembly of claim 24, wherein the removable connection between said vibrationally conductive member and said vibratory transducer comprises magnetic elements therein for establishing a relatively weak magnetic attraction therebetween.

26. The vibrationally conductive assembly of claim 24, wherein the removable connection between said vibrationally conductive member and said vibratory transducer comprises a pressure fit therebetween.

27. The vibrationally conductive assembly of claim 24, wherein the removable connection between said vibrationally conductive member and said vibratory transducer comprises a locking mechanism therebetween.

28. The vibrationally conductive assembly of claim 1, wherein said vibrationally conductive member comprises a filament.

29. The vibrationally conductive assembly of claim 1, wherein said vibrationally conductive member comprises at least one strand.

30. The vibrationally conductive assembly of claim 1, wherein said vibrationally conductive member comprises multiple strands, at least two of said multiple strands having different physical properties to provide a desired combined characteristic thereof.

31. The vibrationally conductive assembly of claim 1, wherein said vibrationally conductive member comprises multiple strands, and said multiple strands are braided.

32. The vibrationally conductive assembly of claim 1, wherein said vibrationally conductive member comprises multiple strands, and said multiple strands are connected to one or more vibratory transducers.

33. The vibrationally conductive assembly of claim 1, wherein said vibrationally conductive member comprises at least one coiled segment.

34. The vibrationally conductive assembly of claim 1, wherein said vibrationally conductive member comprises at least two segments, said at least two segments having different physical properties to provide a desired combined characteristic thereof.

35. The vibrationally conductive assembly of claim 1, wherein said vibrationally conductive member is adjustable in length.

36. The vibrationally conductive assembly of claim 1, wherein said vibrationally conductive member is disposable for ready replacement thereof.

37. The vibrationally conductive assembly of claim 1, wherein said vibrationally conductive assembly or any part thereof is detachable from said vibratory transducer or said tympanic membrane for replacement of said vibrationally conductive assembly or any part thereof, and, during unintended movement of the vibratory transducer, to prevent damage to the tympanic membrane when said vibrationally conductive assembly is coupled to said tympanic membrane.

38. The vibrationally conductive assembly of claim 1, wherein said vibrationally conductive member conducts the audible vibrations at least partially by means of axial motion of the vibrationally conductive member.

39. The vibrationally conductive assembly of claim 1, wherein said vibrationally conductive member conducts the audible vibrations at least partially by means of rocking motion of the vibrationally conductive member.

40. A hearing device constructed and adapted to fit and be worn within the ear canal of a human subject for imparting audible vibrations to the tympanic membrane of the subject, comprising:

a vibratory transducer responsive to signals representative of audio signals for conversion thereof to vibrations; and a vibrationally conductive assembly coupled to said vibratory transducer to receive vibrations emanating therefrom for transferring the received vibrations directly to said tympanic membrane, said vibrationally conductive assembly including a thin elongate vibrationally conductive member coupled to the vibratory transducer for receiving and conducting vibrations to the tympanic membrane.

41. The hearing device of claim 40, wherein said vibrationally conductive assembly further includes:

a tympanic coupling element for contacting said tympanic membrane to transfer the received and conducted vibrations and impart audible vibrations thereto.

42. The hearing device of claim 40, wherein said vibrationally conductive assembly is non-occlusive within said ear canal.

43. The hearing device of claim 40, wherein the device is a hearing aid constructed and adapted to be worn completely within the ear canal of a hearing impaired individual.

44. The hearing device of claim 40, further including a microphone, a signal processing amplifier, controls, and a battery.

45. The hearing device of claim 40, wherein said hearing device is constructed and adapted to be positioned substantially within the bony portion of the ear canal of the wearer.

46. The hearing device of claim 40, wherein the hearing device is substantially non-occlusive within said ear canal.

47. The hearing device of claim 44, wherein said vibrationally conductive assembly provides an energy efficiency, by virtue of transferring vibrations received from said vibratory transducer directly to said tympanic membrane, sufficient to enable said hearing device to be positioned and operational in the ear canal of the wearer for a period exceeding one month before dissipation of said battery to an extent requiring replacement thereof.

48. The hearing device of claim 44, further including remote control means adapted to be positioned substantially external to the ear of the wearer of said hearing device.

49. The hearing device of claim 48, further including a magnetic switch, and wherein said remote control means comprises an external magnetic device for operating said magnetic switch.

50. The hearing device of claim 44, further including a moisture guard for protecting said microphone against damage from moisture.

51. The hearing device of claim 43, further including an acoustic screen for inhibiting feedback by preventing air-conduction vibrations of said tympanic membrane from reaching said microphone.

52. The hearing device of claim 44, comprising a plurality of removable disposable elements including said vibrationally conductive assembly, said vibrationally conductive member or tympanic coupling element of said vibrationally conductive assembly, said battery, a moisture guard, an acoustic screen, and a device retainer.

53. The hearing device of claim 40, wherein the device is a test module constructed and adapted to be worn within the ear canal of a human subject, and, in conjunction with an audiometric module external to said ear canal, for conducting audiometric evaluation and fitting prescription for the subject.

54. The hearing device of claim 40, further including a retainer for stabilizing and securing said device within the ear canal of the wearer.

55. The hearing device of claim 54, wherein said retainer is non-occlusive within said ear canal of the wearer.

56. The hearing device of claim 54, wherein the hearing device is a hearing aid, and said retainer is occlusive within said ear canal for inhibiting feedback by preventing air-conduction vibrations of said tympanic membrane from reaching a microphone of said hearing aid.

57. The hearing device of claim 54, wherein said retainer is oxygen permeable.

58. The hearing device of claim 40, further including a biocompatible adhesive for securing said device to the walls of said ear canal.

59. The hearing device of claim 58, wherein said biocompatible adhesive is oxygen permeable.

60. The hearing device of claim 40, further including spacing pads to minimize contact with and pressure on said ear canal of the wearer and to allow air circulation to the tissue of the ear canal and tympanic membrane.

61. The hearing device of claim 40, wherein the device is a receiver for receiving wireless signals representative of audio signals from an external audio transmitter, and said vibratory transducer is responsive to the received wireless signals for conversion thereof to audible vibrations.

62. The hearing device of claim 61, wherein said wireless signals include any of electromagnetic, radio frequency, ultrasonic and optical signals.

63. The hearing device of claim 40, wherein said vibratory transducer comprises a suspended magnet for vibration in response to a radiant electromagnetic signal representative of an audio signal transmitted by a coil external to the ear canal of the wearer.

64. The hearing device of claim 40, wherein said vibratory transducer includes a vibratory diaphragm.

65. The hearing device of claim 40, wherein said vibratory transducer includes a vibratory armature.

66. The hearing device of claim 40, wherein said vibratory transducer includes a vibratory pad.

67. The hearing device of claim 40, wherein said vibratory transducer includes an electromagnetic moving mechanism comprising at least one coil.

68. The hearing device of claim 40, wherein said vibratory transducer includes an electromagnetic moving mechanism comprising magnetic material.

69. The hearing device of claim 40, wherein said vibratory transducer comprises an element selected from a group consisting of a piezoelectric element, an electrostatic element, an electret element, and a magnetostrictive element.

70. The hearing device of claim 40, wherein said hearing device is non-occlusive within the ear canal of the wearer to optimize air circulation to the tissue of the ear canal and tympanic membrane, and to avoid occlusion effect characterized by unnatural self-voice perception of the wearer.

71. The hearing device of claim 40, wherein said hearing device is non-occlusive within the ear canal of the wearer to enable simultaneous perception of sound though vibratory conduction via said vibrationally conductive assembly, and through air-conduction via air in the non-occluded ear canal.

72. The hearing device of claim 40, including a housing enclosing components of the device, said housing being relatively thin, with a thickness less than 0.25 mm.

73. The hearing device of claim 40, including a rigid housing enclosing components of the device.

74. The hearing device of claim 40, including a resilient housing enclosing components of the device.

75. The hearing device of claim 40, further including flexible or articulating means to conform to the contours of the ear canal when said hearing device is worn therein.

76. The vibrationally conductive assembly of claim 1, wherein said vibrationally conductive member is adapted to occupy the ear canal of the wearer without occlusion thereof.

77. A hearing device constructed and adapted to fit and be worn within the ear canal of a human subject for imparting audible vibrations to the tympanic membrane of the subject, comprising:

a microphone for receiving the incoming signals representative of audio signals and converting them to electrical signals;

an amplifier for processing and amplifying the electrical signal output of the microphone;

a vibratory transducer responsive to said amplified signals for conversion thereof to vibrations; and a vibrationally conductive assembly coupled to said vibratory transducer to receive vibrations emanating therefrom for transferring the received vibrations directly to said tympanic membrane, said vibrationally conductive assembly including:

a thin elongate vibrationally conductive member coupled to the vibratory transducer for receiving and conducting vibrations to the tympanic membrane, and a tympanic coupling element for contacting said tympanic membrane to transfer the received and conducted vibrations and impart audible vibrations thereto.

* * * * *